US007140599B1

(12) United States Patent
Spink

(10) Patent No.: US 7,140,599 B1
(45) Date of Patent: Nov. 28, 2006

(54) COUPLING SYSTEMS AND METHODS FOR MARINE BARRIERS

(76) Inventor: Richard Spink, 18662 Colony Rd., Bow, WA (US) 98232

( * ) Notice: Subject to any disclaimer, the term of this patent is extended or adjusted under 35 U.S.C. 154(b) by 0 days.

(21) Appl. No.: 11/179,094

(22) Filed: Jul. 11, 2005

Related U.S. Application Data

(63) Continuation of application No. 10/749,849, filed on Dec. 30, 2003, now abandoned.

(60) Provisional application No. 60/485,532, filed on Jul. 7, 2003, provisional application No. 60/437,664, filed on Dec. 31, 2002.

(51) Int. Cl.
*B63G 9/04* (2006.01)
*E02B 15/06* (2006.01)

(52) U.S. Cl. ..... 256/13; 114/241; 405/71

(58) Field of Classification Search ..... 405/60, 405/63, 66, 70, 71, 67, 68, 69; 210/923, 210/242.3; 114/204 R–240 E; 441/65; 256/13
See application file for complete search history.

(56) References Cited

U.S. PATENT DOCUMENTS

| | | | | | |
|---|---|---|---|---|---|
| 1,151,607 | A | * | 8/1915 | Newhall et al. | 114/241 |
| 2,369,464 | A | * | 2/1945 | Kalnitz | 114/240 R |
| 2,693,161 | A | | 11/1954 | Stubbs | 405/71 |
| 3,101,491 | A | * | 8/1963 | Salo | 441/23 |
| 3,537,587 | A | * | 11/1970 | Kain | 210/242.3 |
| 3,564,852 | A | * | 2/1971 | Smith | 405/66 |
| 3,638,430 | A | | 2/1972 | Smith | 405/66 |
| 3,688,506 | A | * | 9/1972 | Marcocchio et al. | 405/63 |
| 3,800,542 | A | | 4/1974 | Cerasari | 405/72 |
| 3,804,177 | A | * | 4/1974 | Renfroe | 172/26.5 |
| 3,952,521 | A | * | 4/1976 | Potter | 405/27 |
| 3,998,060 | A | * | 12/1976 | Preus | 405/70 |
| 4,033,137 | A | | 7/1977 | Geist | 405/71 |
| 4,073,143 | A | * | 2/1978 | Preus | 405/70 |
| 4,104,884 | A | * | 8/1978 | Preus | 405/68 |
| 4,124,981 | A | * | 11/1978 | Preus | 405/66 |
| 4,300,856 | A | * | 11/1981 | Magoon et al. | 405/66 |
| 4,320,990 | A | * | 3/1982 | Heasman | 405/66 |
| 4,422,797 | A | | 12/1983 | McAllister et al. | 405/70 |
| 4,432,874 | A | | 2/1984 | Lundin | 210/242.4 |
| 4,738,563 | A | | 4/1988 | Clark | 405/52 |
| 4,961,393 | A | * | 10/1990 | Murray | 114/240 R |
| 5,000,616 | A | | 3/1991 | Bell et al. | 405/66 |
| 5,114,272 | A | * | 5/1992 | Brunhoff et al. | 405/66 |

(Continued)

OTHER PUBLICATIONS

Harbor Offshore, Inc. Marine Contractors; undated photograph printed off the Internet on Sep. 7, 2004 (http://hoi1.com/i/comp/co3_lrg.jpg).

*Primary Examiner*—Patricia L. Engle
*Assistant Examiner*—Gay Ann Spahn
(74) *Attorney, Agent, or Firm*—Michael R. Schacht; Schacht Law Office, Inc.

(57) ABSTRACT

A marine barrier system comprising first and second barrier sections and a coupler system. The first and second barrier sections comprise first and second main flotation members, respectively, and each main flotation member contains buoyant material. The coupler system is arranged at the juncture of the first and second barrier sections. The coupler system is arranged such that the first and second main flotation members may be placed in a storage configuration and in a deployed configuration. In the storage configuration, the first and second main flotation members are arranged in a parallel, side by side arrangement. In the deployed configuration, the first and second main flotation members are arranged end to end to define a barrier line in a body of water across which movement is limited.

8 Claims, 20 Drawing Sheets

U.S. PATENT DOCUMENTS 5,188,482 A * 2/1993 Braun ..... 405/70
5,301,925 A * 4/1994 Carlson ..... 256/13
5,480,262 A 1/1996 Russo, III ..... 405/66
5,688,075 A * 11/1997 Gradek ..... 405/63
6,358,405 B1 * 3/2002 Leahy ..... 210/85
6,591,774 B1 * 7/2003 Metherell et al. ..... 114/241
6,681,709 B1 * 1/2004 Nixon et al. ..... 114/241
6,843,197 B1 * 1/2005 Nixon et al. ..... 114/241
6,877,456 B1 * 4/2005 Metherell et al. ..... 114/382
6,960,047 B1 * 11/2005 Knezek et al. ..... 405/211
6,980,483 B1 * 12/2005 McDonald ..... 367/93
7,044,076 B1 * 5/2006 Knezek et al. ..... 114/267
7,056,059 B1 * 6/2006 Wong et al. ..... 405/63
2003/0051652 A1 * 3/2003 Metherell et al. ..... 114/241
2003/0136325 A1 * 7/2003 Wooley et al. ..... 114/240 R
2004/0266287 A1 * 12/2004 Hampton et al. ..... 441/6
2005/0042033 A1 * 2/2005 Fong ..... 405/63
2006/0034668 A1 * 2/2006 Knezek et al. ..... 405/211
2006/0037526 A1 * 2/2006 Knezek et al. ..... 114/267

* cited by examiner

COUPLING SYSTEMS AND METHODS FOR MARINE BARRIERS

RELATED APPLICATIONS

This is a continuation of U.S. Ser. No. 10/749,849 filed Dec. 30, 2003, now Abandoned, which claims benefit of U.S. Provisional Application Ser. Nos. 60/437,664 filed on Dec. 31, 2002, and 60/485,532 filed on Jul. 7, 2003. The contents of all related applications listed above are incorporated herein by reference.

TECHNICAL FIELD

The present invention relates to marine barriers and, more particularly, to barrier systems and methods that may be deployed on a body of water to protect watercraft and/or marine installations.

BACKGROUND OF THE INVENTION

Security concerns make it desirable to limit access to watercraft and/or marine installations. For example, unauthorized persons may be prevented from boarding a docked or moored vessel relatively easily, but preventing an unauthorized person from approaching a vessel from the water can be difficult. The need thus exists for systems and methods for establishing a barrier line in the water to inhibit access over the water by unauthorized personnel to a vessel in or land installation adjacent to the water.

SUMMARY OF THE INVENTION

The present invention relates to marine barrier system and methods employing at least first and second barrier sections and a coupler system. The first and second barrier sections comprise first and second main flotation members, respectively, and each main flotation member contains buoyant material. The coupler system is arranged at the juncture of the first and second barrier sections. The coupler system is arranged such that the first and second main flotation members may be placed in a storage configuration and in a deployed configuration. In the storage configuration, the first and second main flotation members are arranged in a parallel, side by side arrangement. In the deployed configuration, the first and second main flotation members are arranged end to end to define a barrier line in a body of water across which movement is limited.

DETAILED DESCRIPTION

Figure 1:
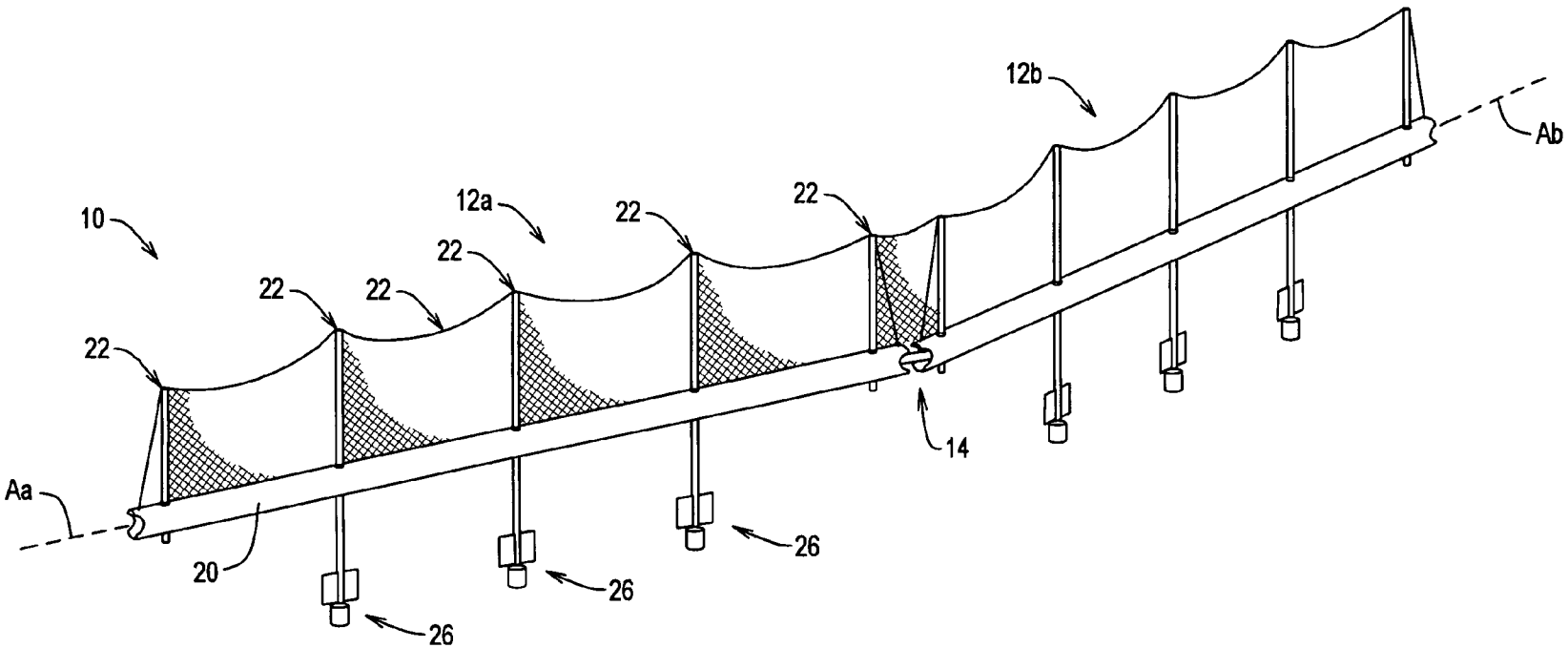
FIG. 1 is a perspective view of a first embodiment of a barrier system of the present invention.

With reference to FIG. 1, a marine barrier system 10 is depicted therein. The barrier system 10 is designed to be deployed on a body of water to restrict movement on the body of water. The exemplary barrier system 10 comprises first and second barrier sections 12*a* and 12*b* connected together using a coupling system 14. Additional barrier sections 12 may be used to obtain a barrier system 10 having a longer effective length. The barrier system 10 is used to restrict access to stationary watercraft and/or onshore or offshore marine installations such as harbors, oilrigs, and the like.

The barrier system 10 may be arranged in a number of configurations depending upon the nature of the restricted site. In each configuration, the barrier system 10 will define a "barrier line" across which movement in the water is obstructed or restricted. For example, the barrier system 10 may be arranged such that the barrier line defines a closed figure that extends completely around a watercraft such as a ship or the like to restrict access to the watercraft. As another example, the barrier system 10 may be arranged to define a straight or curved barrier line extending between two points on a shore to protect a harbor between those two points. The barrier system 10 may also be arranged in a substantially straight line to obstruct passage of a vessel through a straight or narrows. In most situations, at least two locations, usually including the ends, on the barrier system 10 are anchored or otherwise secured to prevent undesired movement of the barrier system. The barrier system 10 may be used in many different configurations and environments, and the specific use to which the barrier system 10 is put is not necessarily part of the present invention.

Each of the segments 12*a* and 12*b* of the exemplary barrier system 10 are identical. The present invention does not require that the segments 12*a* and 12*b* be identical, however, and segments of different types and for different purposes may be developed within the scope of the present invention.

As shown in FIG. 1, each of the barrier segments 12 comprises a boom 20 defining a segment axes Aa and Ab. The exemplary barrier segments 12 further comprise a one or more post systems 22, a net system 24, and a stabilizing system 26. The post systems 22, net system 24, and stabilizing system 26 are optional and are not required to implement the present invention in its broadest form. Typically, however, the post systems 22 and net system 24 will be used to enhance the ability of the barrier system 10 to restrict movement of smaller craft or swimmers that could be lifted or climb over the boom 20 without the net system 24. The stabilizing systems 26 will typically be used to prevent the post systems 22 and net systems 24 from capsizing under normal expected conditions.

Figure 2:
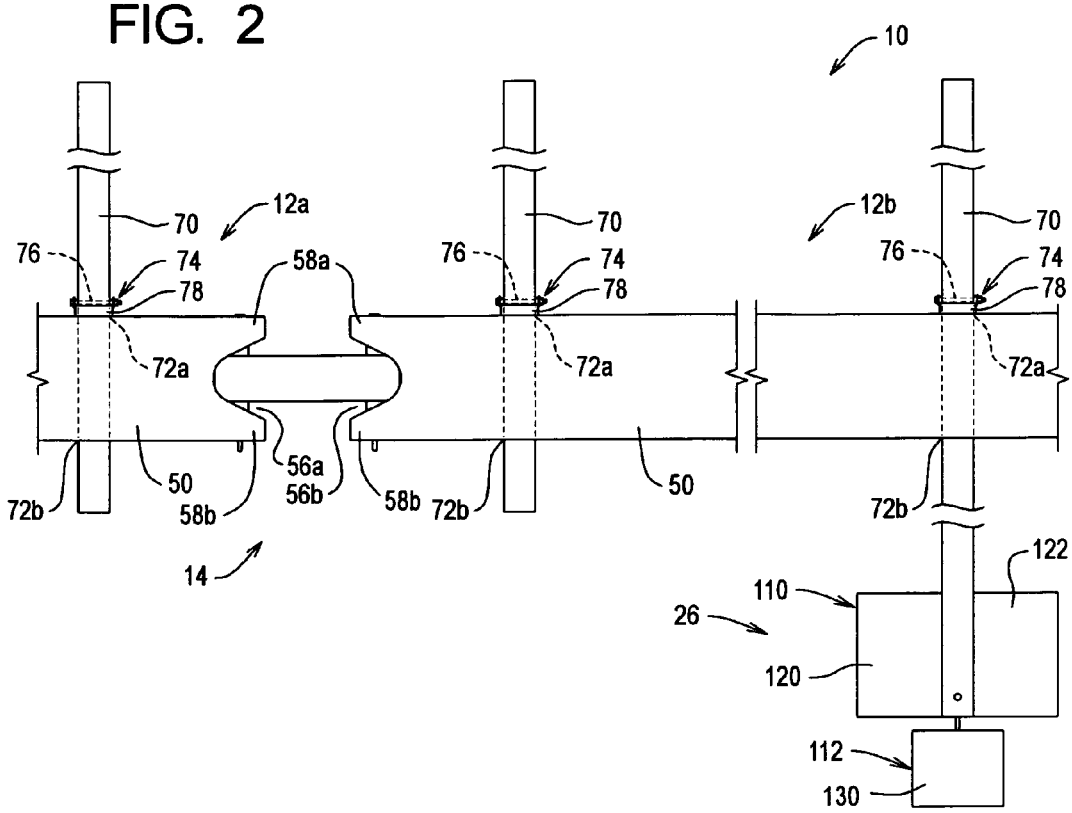
FIG. 2 is a partial, somewhat schematic elevation view of the barrier system depicted in FIG. 1.
Figure 3:
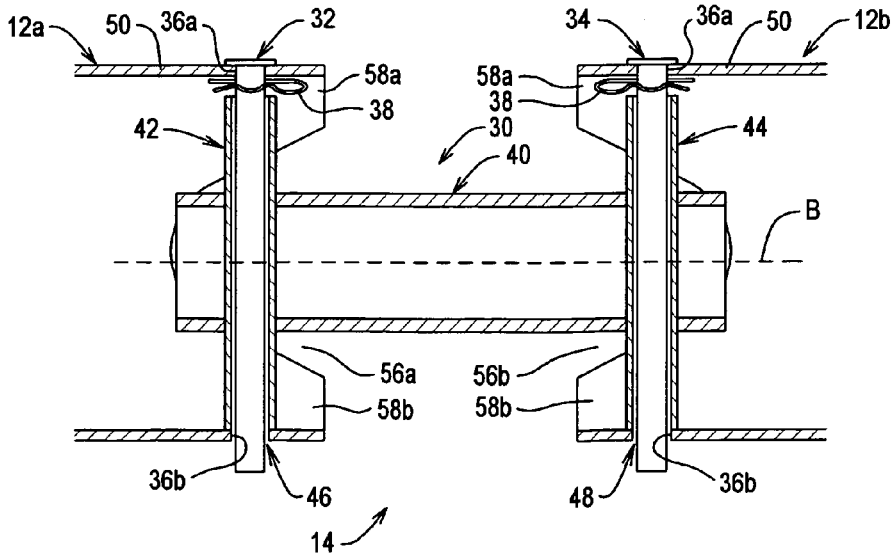
FIG. 3 is a section view of a coupling system used by the barrier system depicted in FIG. 1.

Referring now to FIGS. 2 and 3, each segment 12 is connected to at least one adjacent segment 12 using the coupler system 14. The coupler system 14 comprises a coupler 30 and first and second coupling pins 32 and 34. At least one segment opening 36 is formed in each of the adjacent barrier segments 12. The first and second coupling pins 32 and 34 extend through the coupler 30 and the segment openings 36. The coupler system 14 thus secures the segments 12 together while allowing rotation of the segments 12 relative to each other. Accordingly, the overall shape of barrier system 10 may be curved even though the individual segments 12 are typically straight.

The coupler 30 defines a coupler axis B and comprises a spacing portion 40 and first and second pin portions 42 and 44. The first and second pin portions 42 and 44 define first and second pin passageways 46 and 48. In addition, in the exemplary system 10, each of the segments 12 defines upper and lower segment openings 36*a* and 36*b*.

The coupling systems 14 are formed as follows. First, the pin portions 42 and 44 are arranged such that the first pin passageway 46 is aligned with both the upper and lower segment openings 36*a* and 36*b* defined by one of the segments 12*a* and the second pin passageway 48 is aligned with the upper and lower segment openings 36*a* and 36*b* defined by the other of the segments 12*b*. The first coupling pin 32 is inserted through the first pin passageway 46 and the segment openings 36 aligned therewith. The second coupling pin 34 is inserted through the second pin passageway 48 and the segment openings 36 aligned therewith. A cotter pin 38 is inserted through each of the coupling pins 32 and 34 to prevent removal of these pins 32 and 34 from the pin passageways 46 and 48.

Figure 4:
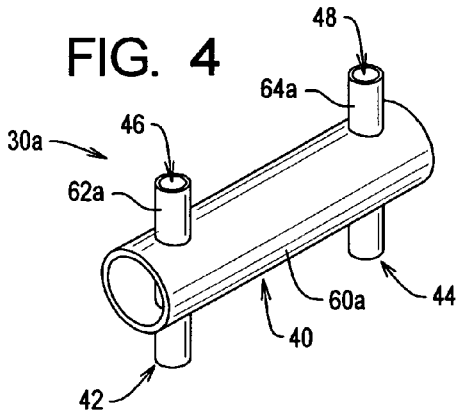
FIG. 4 is a perspective view of an exemplary coupler that may be used by the coupling system of FIG. 3.

FIGS. 2 and 4 illustrate that boom portions 20 of the barrier segments 12 are each formed by a length of float pipe 50. The float pipe 50 is made of a relatively rigid plastic such as high density polyethylene (HDPE) or polyvinyl chloride (PVC). HDPE and PVC provide a desirable combination of rigidity and low weight, but other materials, including steel, polypropylene (PP), acrylonitrile butadiene styrene (ABS), polyvinylidene fluoride (PVDF), high density polyethylene (LDPE), polycarbonate (PC), polymethylmethacrylate (PMMA), polyphenylene sulfide (PPS), and fluoroethylene-propylene (FEP) can be used as well.

The float pipe 50 is preferably a cylindrical pipe, but other shapes of float pipe can be used. The exemplary float pipes 50 are hollow and have a predetermined length, diameter, and wall thickness. The float pipe 50 will typically be provided in standard lengths that define the effective overall length of the barrier segments 12. The float pipe 50 length typically will be selected based upon such factors as the environment in which the system 10 will be used and the manner in which the system 10 is to be transported and deployed. The diameter of the float pipe 50 is normally related to pipe length, with greater lengths requiring larger diameters. As will become apparent from the following discussion, the thickness of the pipe wall will be dictated by such factors as expected environmental conditions and the size and weight of the post systems 22 and the net system 24 supported thereby.

The following Table A contains the standard pipe lengths and SDR numbers for HDPE, which is probably the preferred material for the float pipes 50.

TABLE A

| Material | Length | External Diameter | SDR |
|---|---|---|---|
| HDPE | 10' | preferred: 18<br>first pref. range: 12–24<br>second pref. range: 8–24 | preferred: 32.5<br>first pref. range: 26–41<br>second pref. range: 7.3–41 |
| | 25' | preferred: 18"<br>first pref. range: 12–24"<br>second pref. range: 10–24" | preferred: 32.5<br>first pref. range: 26–41<br>second pref. range: 7.3–41 |
| | 50' | preferred: 18"<br>first pref. range: 16–24"<br>second pref. range: 14–24" | preferred: 32.5<br>first pref. range: 26–41<br>second pref. range: 7.3–41 |

The materials from which the float pipes are made typically do not float or have neutral buoyancy. However, the float pipes 50 are hollow and define an elongate float chamber 52. As shown in FIG. 4, flotation material 54 may optionally be arranged with the chamber 52. The flotation material 54 can be any type of material that will provide sufficient buoyancy to the barrier segments 12 when fully configured with, for example, the optional the post systems 22, net systems 24, and/or stabilizing system 26. Typical flotation materials include shrink-wrapped Styrofoam polystyrene, air, styrene, or similar materials. The flotation material can be injected or sprayed into the float chamber 52 or can be cut or rolled into shapes that can be inserted into the chamber 52. If air is used as a flotation material, the air is captured by sealing the float chamber 52 at the open ends thereof and any holes formed therein.

FIGS. 2 and 3 illustrate that coupler notches 56 are formed in the ends of the float pipes 50. In particular, first and second coupler notches 56*a* and 56*b* are formed in opposite sides of each end of the pipes 50. These notches define upper and lower coupler ears 58*a* and 58*b*. The upper and lower segment openings 36*a* and 36*b* are formed in the upper and lower coupler ears 58*a* and 58*b*, respectively. The coupler notches 56 and associated coupler ears 58 are optional but are preferred in the context of the coupling system 14.

Figure 5:
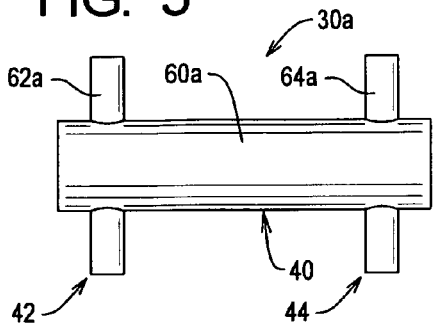
FIG. 5 is an elevation view of the coupler of FIG. 4.

In particular, FIGS. 4 and 5 depict the details of a coupler 30*a* that forms the coupler 30 of the exemplary coupling system 14 of the barrier system 10. The exemplary coupler 30*a* comprises a spacing pipe 60*a* and first and second pin pipes 62*a* and 64*a*. The exemplary spacing pipe 60*a* is a length of HDPE pipe having a diameter of six inches and defines the coupler axis B. The exemplary pin pipes 62*a* and 64*a* are lengths of HDPE pipe having a diameter of two inches and define the first and second pin passageways 46 and 48. The pin pipes 62*a* and 64*a* are inserted through holes in, and bonded to, the spacing pipe 60*a* such that the pin passageways 46 and 48 are substantially parallel to each other and spaced apart by a predetermined spacing distance.

In the preferred barrier system 10, the spacing distance is approximately equal to the diameter of one of the float pipes 50. In addition, a depth of the coupler notches 56 is at least as large as the diameter of the spacing pipe 60*a*. Further, the segment openings 36 are formed in the coupler ears 58 approximately one-half of the depth of the coupler notches 56 from the ends of the float pipes 50.

Figure 6:
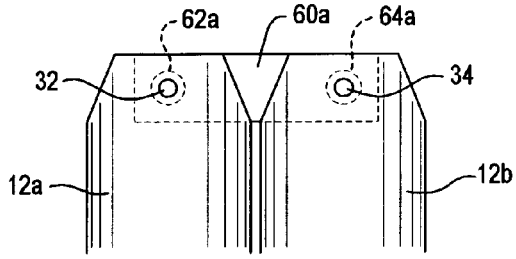
FIG. 6 is a top plan view of the coupling system of FIG. 3 in a storage/transportation configuration.

Accordingly, as shown in FIG. 6, the coupler system 14 can be placed into a storage/transportation configuration in which barrier segments 12*a* and 12*b* are rotated back with respect to each other. In the storage/transportation configuration, the barrier segments 12*a* and 12*b* are parallel to each other but side-by-side. In contrast, during normal use the barrier segments 12*a* and 12*b* may or may not be parallel but will typically not be arranged side-by-side. The coupler system 14 thus allows the barrier segments 12 to be prefabricated together into a barrier system having an effective length that is a multiple of the lengths of the individual barrier segments 12.

Figure 7:
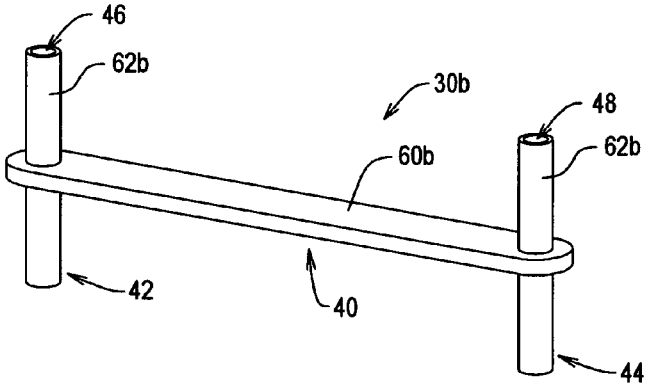
FIG. 7 is a perspective view of a first alternative coupler that may be used in place of the coupler depicted in FIG. 3.

FIG. 7 illustrates a second exemplary coupler 30*b* that may be used as the coupler 30 described above. The coupler 30*b* comprises a spacing plate 60*b* and first and second pin pipes 62*b* and 64*b*. The spacing plate 60*b* is a rectangular rigid member of plastic, metal, or the like that performs substantially the same function as the spacing pipe 60*a* described above. The pin pipes 62*b* and 64*b* are made of a rigid material that may be bonded, welded, or otherwise secured to the plate 60*b* to bear the loads expected under expected operating conditions. The coupler 30*b* can be made with a single spacing plate 60*b* or two or more such plates connected in a manner that will bear the loads expected on the coupler system 14.

Figure 8:
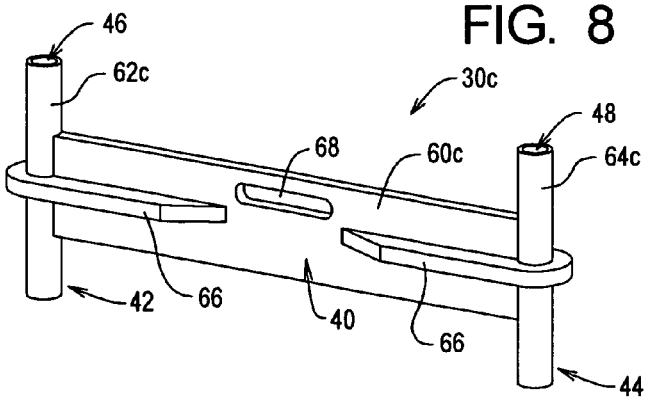
FIG. 8 is a perspective view of a second alternative coupler that may be used in place of the coupler depicted in FIG. 3.

FIG. 8 illustrates a third exemplary coupler 30*c* that may be used as the coupler 30 described above. The coupler 30*c* comprises a spacing bar 60*c* and first and second pin pipes 62*c* and 64*c*. The spacing bar 60*c* is a rectangular rigid member of plastic, metal, or the like that performs substantially the same function as the spacing pipe 60*a* and spacing plate 60*b* described above. The pin pipes 62*b* and 64*b* are made of a rigid material that may be bonded, welded, or otherwise secured to the bar 60*c* to bear the loads expected under expected operating conditions. Bracing flanges 66 are provided to brace the connection between the spacing bar 60*c* and pin pipes 62*c* and 64*c*. While the bracing flanges 66 extend only part way along the spacing bar 60*c* in FIG. 8, these flanges 66 can be made to extend along, and thus reinforce, the entire spacing bar 60*c* if desired. Again, two or more spacing bars may be connected to form the coupler 30*c*.

Referring now for a moment back to FIG. 2, that figure shows that the post systems 22 each comprise a post 70 as a primary structural member. The post 70 may be any rigid member that can bear the expected loads. Typically, the expected loads on the posts 70 will be arise from the weight of the net system 24 and any additional force that may be externally applied by wind, water, watercraft, or the like. These posts 70 are typically made of 4" hollow plastic pipe having an SDR of 11, but other materials may be used depending upon the details of the net system 24.

As shown in FIG. 2, each post 70 extends through at least one post opening 72 formed in the float pipe 50. In the exemplary barrier system 10, upper and lower post openings 72*a* and 72*b* are formed for each post 70. Each post 70 extends through the upper opening 72*a*, the pipe chamber 52, and the lower opening 72*b*. To prevent the posts 70 from passing through the post openings 72, a post bolt assembly 74 is provided for each post 70. The post bolt assemblies 74 pass through the bolt openings 76 formed at predetermined locations in the posts 70. The post bolt assemblies 74 increase the effective diameter of the posts 70 such that the posts 70 cannot pass completely through the post openings 72. The locations of the bolt openings 76 determine how much of the post 70 is above and how much is below the float pipe 50.

Optional post spacers 78 may be arranged between the post bolt assemblies 74 and the float pipe 50. The post spacers 78 are annular members defining an inner diameter that can receive outer diameter of the posts 70 and an outer diameter that is larger than the post openings 72. Under normal conditions, the post bolt assemblies 74 bear on the post spacers 78 and not directly on the wall of the float pipe 50 around the post openings 72. The post spacers 78 thus protect the wall of the float pipe 50 from premature wear.

In the exemplary barrier system 10, only one set of bolt assemblies 74 is provided for each post 70. A second set of bolt assemblies 74 may be provided within or under the pipe 50 to prevent the post 70 from being withdrawn from the post openings 72. As will be described in further detail below, however, a second set of bolt assemblies 74 is not required if the stabilizing system 26 is used.

Figure 9:
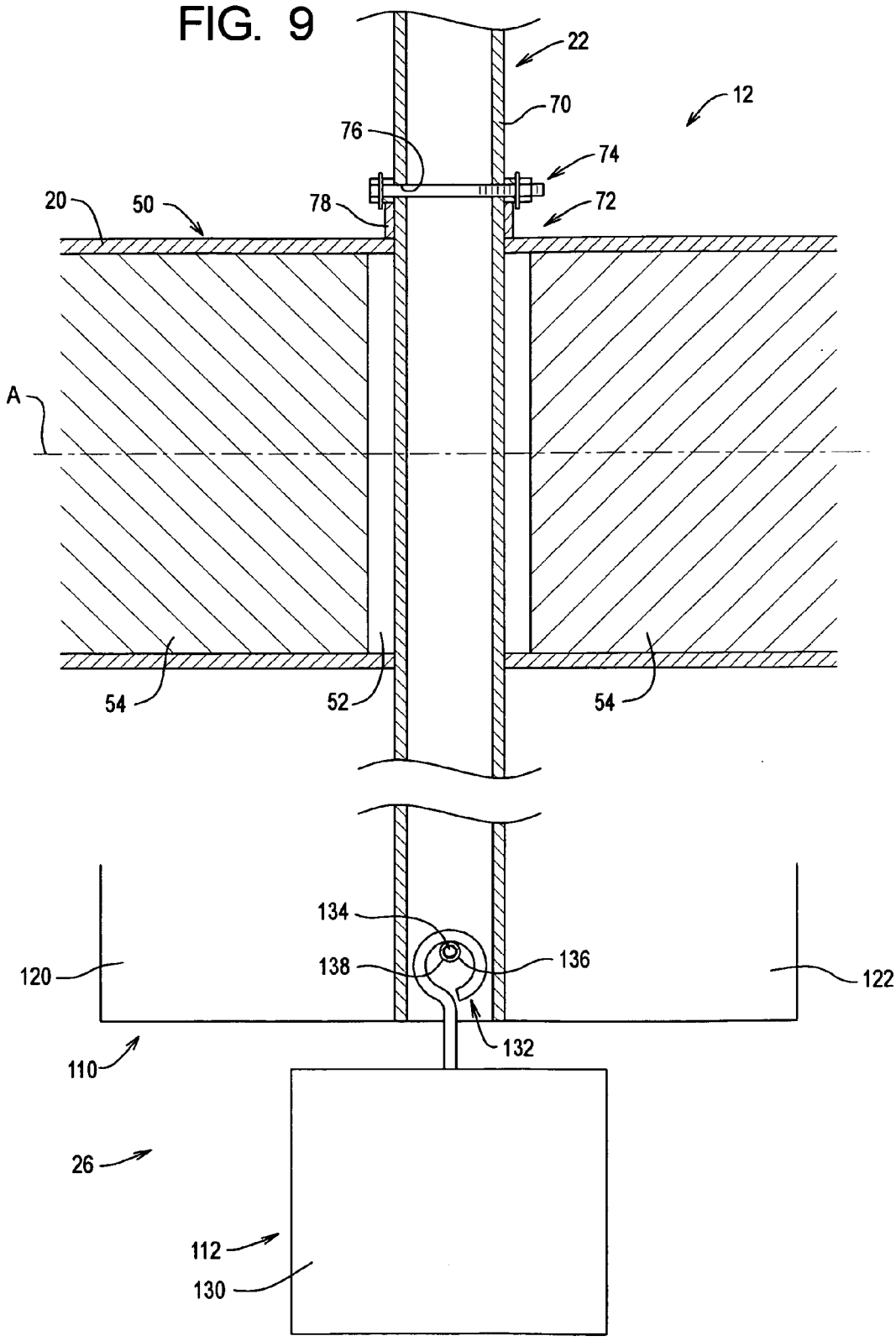
FIG. 9 is a somewhat schematic section view of a stabilizing system used by the barrier system depicted in FIG. 1.

Referring now to FIG. 9, the optional stabilizing system 26 will now be described in further detail. The exemplary stabilizing system 26 comprises a keel system 110 and a ballast system 112. The stabilizing system 26 may be implemented using either or both of the keel system 110 and the ballast system 112.

The keel system 110 comprises first and second keel plates 120 and 122 bonded to a lower end of one of the one or more of the posts 70. The exemplary keel plates 120 and 122 are parallel and lie within a keel axis C, but other configurations are possible. In addition, while two keel plates 120 and 120 are used by the exemplary stabilizing system 26, one, three, or more keel plates may be used. The keel plates 120 and 122 lie under the water and engage the water in the same manner as a keel of a sailboat to help maintain the posts 70 in an upright configuration.

The ballast system 112 comprises a ballast member 130 that is suspended from the lower end of one or more of the posts 70. The ballast member 130 acts like ballast in a ship to maintain the posts 70 in an upright configuration.

Figure 10:
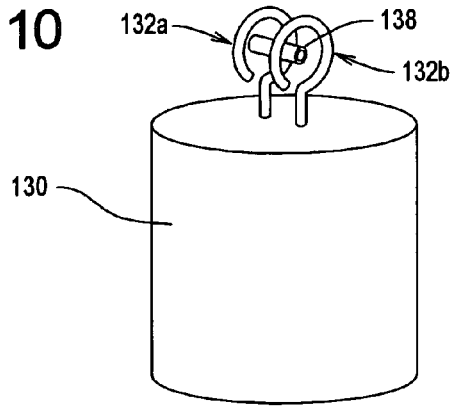
FIG. 10 is a partial perspective view of a counterweight portion of the stabilizing system of FIG. 9.

As shown in FIG. 10, the exemplary ballast member 130 is a cylinder of concrete. The shape of ballast member 130 and material from which this member 130 is made are not critical to any given implementation of the present invention. Concrete is, however, desirable because it is not susceptible to corrosion, and the ballast members 130 can easily be fabricated by relatively unskilled workers at the deployment site to reduce shipping costs.

FIG. 10 also shows that first and second eyebolts 132*a* and 132*b* extend from the ballast member 130. One, three, or more such eyebolts 132 may be used. The eyebolts 132 may be secured to a concrete ballast member 130 by placing a portion of the eyebolts into the wet concrete and allowing the concrete to harden. FIGS. 9 and 10 illustrate that ballast bolt assemblies 134 are passed through the eyebolts 132 and ballast holes 136 in the lower ends of the posts 70. The bolts of the ballast bolt assemblies 134 are preferably inserted through ballast spacers 138 to reduce wear between these bolts and the eyebolts 132. Other systems can be used to secure the ballast members 130 to the posts 70.

The keel plates 20 and 22 and/or the ballast members 130 will prevent the posts 70 from being withdrawn from the post openings 72 under normal use of the barrier system 10. Further, because the net system 24 is connected to posts having a stabilizing system, any post 70 not provided with a stabilizing system 26 will be held in place by the net system 24.

Figure 11:
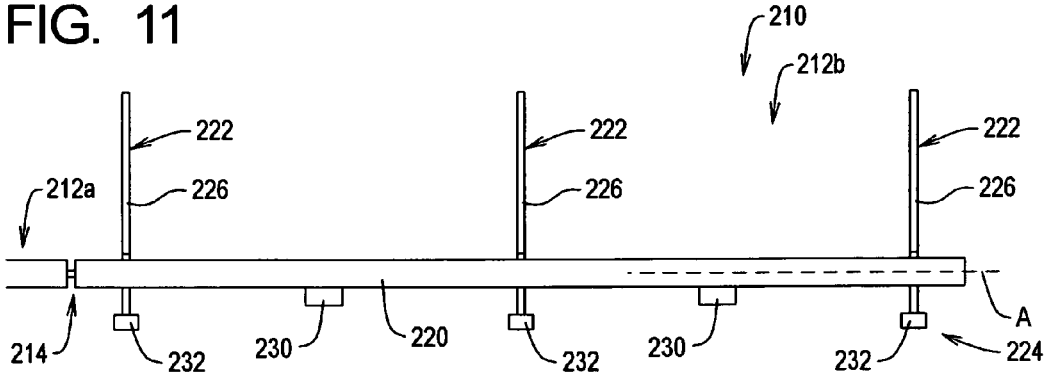
FIG. 11 is an elevation view of a portion of a second embodiment of a barrier system of the present invention.

A second exemplary barrier system 210 will now be described with reference to FIG. 11. The barrier system 210 is similar to the system 10 described above in that the system 210 is designed to be deployed on a body of water to restrict movement on the body of water. The exemplary barrier system 210 comprises first and second barrier sections 212*a* and 212*b* connected together using a coupling system 214. Additional barrier sections 212 may be used to obtain a barrier system 210 having a longer effective length. Like the barrier system 10 described above, the barrier system 210 may be arranged in a number of configurations depending upon the nature of the restricted site.

Each of the segments 212*a* and 212*b* of the exemplary barrier system 210 are identical. The present invention does not require that the segments 212*a* and 212*b* be identical, however, and segments of different types and for different purposes may be developed within the scope of the present invention. Each of the barrier segments 212 comprises a boom 220. The exemplary barrier segments 12 further comprise one or more post systems 222, and a stabilizing system 224. Each post system 222 comprises a post 226. A net system may be supported by the post system 222, but no net system is shown in FIG. 11 for purposes of clarity.

The primary difference between the barrier system 10 and the barrier system 210 is the manner in which the stabilizing system 224 is implemented. In particular, the stabilizing system 224 comprises keel plates 230 and ballast members 232. However, the keel plates 230 are attached to the underside of the boom 220 rather than on the posts 226. The ballast members 232 are secured to the lower ends of at least some of the posts 226. However, the ballast members 232 are concrete, and the lower ends of the posts 226 are embedded within the concrete to form the connection between the posts 226 and the ballast members 232.

Any suitable coupler, including the coupler system 14 described above, may be used to form the coupling system 214.

Figure 12:
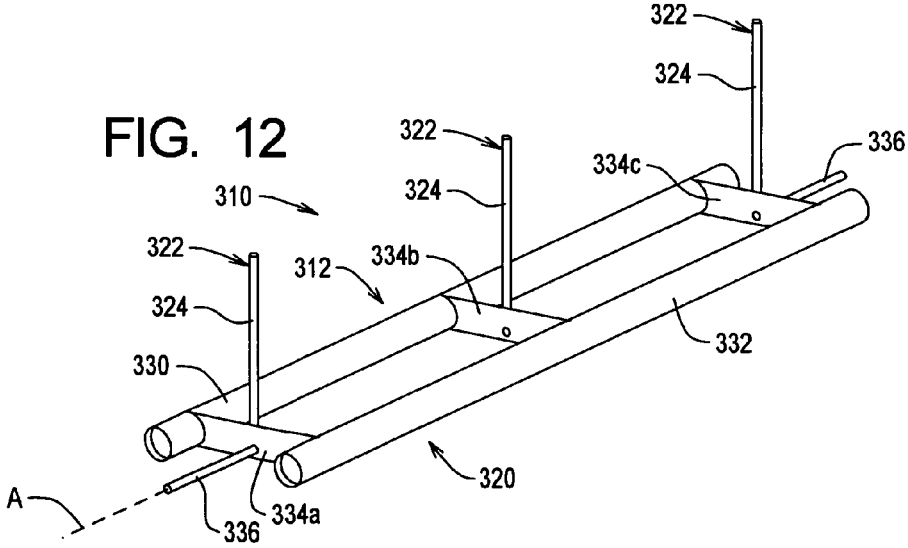
FIG. 12 is an elevation view of a barrier segment of a third embodiment of a barrier system of the present invention.

A third exemplary barrier system 310 will now be described with reference to FIG. 12. The barrier system 310 is similar to the systems 10 and 210 described above in that the system 310 is designed to be deployed on a body of water to restrict movement on the body of water.

Like those systems, the exemplary barrier system 310 comprises one or more barrier sections 312 that may be connected together using a coupling system (not shown). Additional barrier sections 312 may be used to obtain a barrier system 310 having a longer effective length. Like the barrier systems 10 and 210 described above, the barrier system 310 may be arranged in a number of configurations depending upon the nature of the restricted site. The barrier segments 312 are but need not be identical. Each of the barrier segments 312 comprises a boom assembly 320 and one or more post systems 322. Each post system 322 comprises a post 324.

The primary difference between the barrier systems 10 and 210 and the barrier system 310 is the manner in which buoyancy is provided to the system 310. In particular, the boom assembly 320 comprises first and second float pipes 330 and 332. These float pipes 330 and 332 are connected by spacing struts 334. The posts 324 are secured to center portions of the spacing struts 334. The segment axis defined by each segment 312 extends through the locations at which the posts 324 are mounted to the struts 334 and not through either of the float pipes 330 or 332.

Using the struts 334 to space the float pipes 330 and 332 from the segment axis provides inherent stability against capsizing of the segment 312 when lateral loads are applied to the posts 324. The barrier system 310 thus does not require an underwater stabilizing system and can be used in shallow water environments.

Coupling bars 336 extend from the endmost spacing struts 334*a* and 334*c* to allow two or more segments 312 to be joined together. Any suitable coupler, including the coupler system 14 described above, may be used to connect the coupling bars 336 together. In addition, combinations of the barrier segments 312 with barrier segments of other types such as the segments 12 and 212 described above when the overall barrier system traverses both deep and shallow water.

Figure 13:
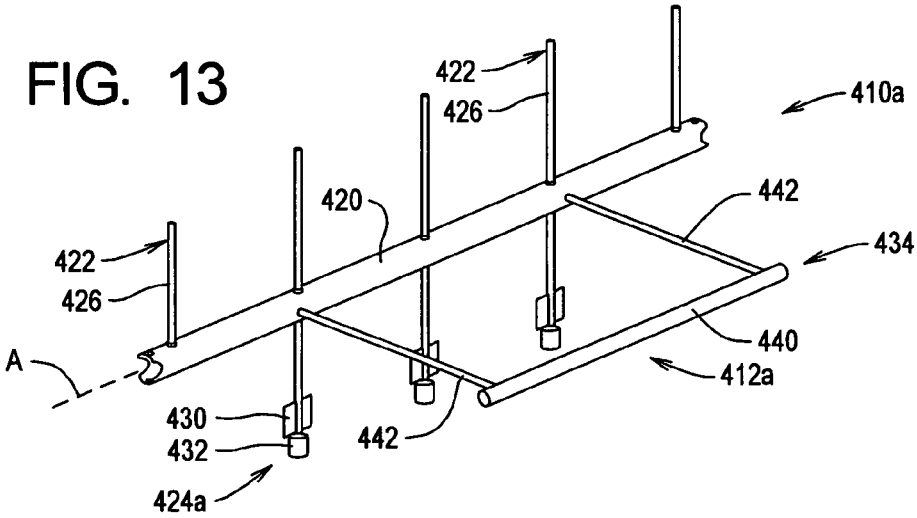
FIG. 13 is a perspective view of a barrier segment of a fourth embodiment of a barrier system of the present invention.
Figure 14:
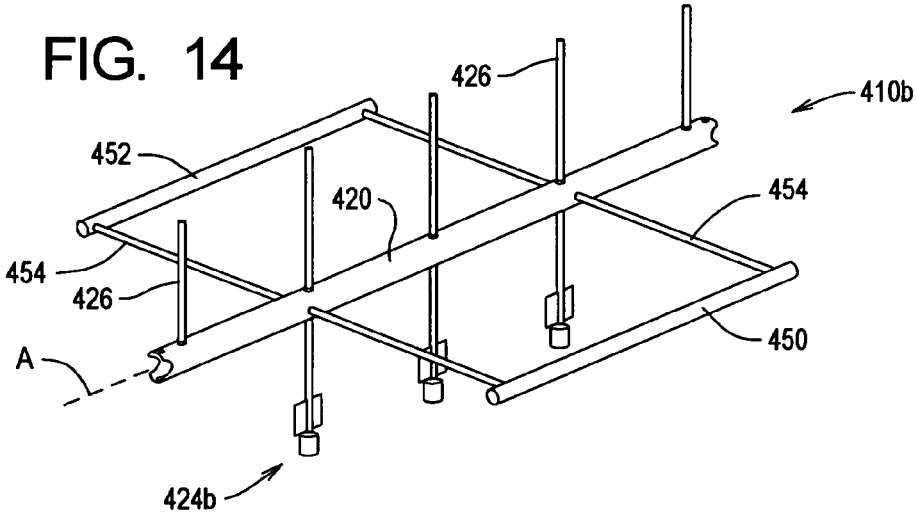
FIG. 14 is an elevation view of a barrier segment of a fifth embodiment of a barrier system of the present invention.

Referring now to FIGS. 13 and 14, depicted therein are fourth and fifth exemplary barrier systems 410*a* and 410*b*, respectively. The barrier systems 410*a* and 410*b* are similar and will be described separately below only to the extent that these systems 410*a* and 410*b* differ.

The fourth exemplary barrier system 410*a* is similar to the systems 10, 210, and 310 described above in that the system 410*a* is designed to be deployed on a body of water to restrict movement on the body of water. The exemplary barrier system 410*a* comprises one or more barrier sections 412*a* connected together using a coupling system (not shown). Additional barrier sections 412*a* may be used to obtain a barrier system 410*a* having a longer effective length. Like the barrier systems 10, 210, and 310 described above, the barrier system 410*a* may be arranged in a number of configurations depending upon the nature of the restricted site.

Each of the segments 412*a* of the exemplary barrier system 410*a* are, but need not be, identical. Each of the barrier segments 412*a* comprises a main boom 420, one or more post systems 422, and a stabilizing system 424*a*. Each post system 422 comprises a post 426. A net system may be supported by the post system 422, but no net system is shown in FIGS. 13 and 14 for purposes of clarity. The main boom 420 defines the segment axis A.

The primary difference between the barrier system 10 and the barrier systems 410*a* and 410*b* is the manner in which the stabilizing system 424*a* is implemented. In particular, in the barrier system 410*a* the stabilizing system 424*a* comprises, in addition to keel plates 430 and ballast members 432, an outrigger structure 434.

The outrigger structure 434 comprises an outrigger boom 440 and one or more outrigger struts 442. The outrigger struts 442 are connected at one end to the main boom 420 and at the other end to the outrigger boom 440. The outrigger struts 442 thus space the outrigger boom 440 from the segment axis A; the outrigger boom 440 is, like the main boom 420, buoyant and will oppose lateral forces on the posts 426 that would otherwise tend to capsize the segment 412*a*.

The outrigger boom 440 is, like the main boom 420, typically a hollow tube filled with buoyant material. The outrigger struts 442 are smaller diameter hollow tubes that extend through the main boom 420 and the outrigger boom 440 such that axial rotation of the main boom 420 would be converted into orbital displacement of the outrigger boom 440 around the main boom 420. However, when the segment 412*a* is placed in the water as shown in FIG. 13, the outrigger boom 440 stabilizes the segment 412*a* as described above.

The barrier system 410*b* is the same as the barrier system 410*a* except that the stabilizing system 424*b* comprises two outrigger booms 450 and 452. In addition, outrigger struts 454 extend between the outrigger booms 450 and 452 through the main boom 420. The outrigger booms 450 and 452 thus provide stability against lateral forces applied in either direction to the posts 426.

The connections between the outrigger struts 442 and 454 and the main boom 420 or the outrigger booms 440, 450, and 452 are or may be similar to the connections between the posts 426 and the main boom 420. The coupling system may be any coupling system capable of securing the adjacent main booms 420 together, including the coupling system 14 described above.

Figure 15:
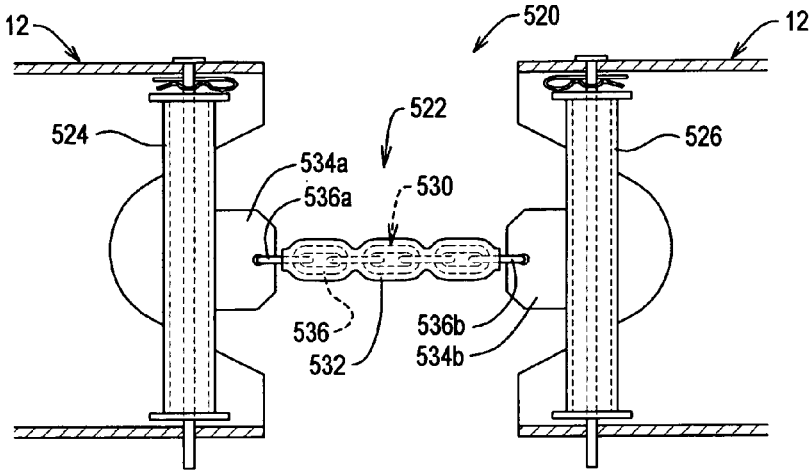
FIG. 15 is side elevation partial section view depicting another alternative coupler system that may be used by the present invention.
Figure 16A:
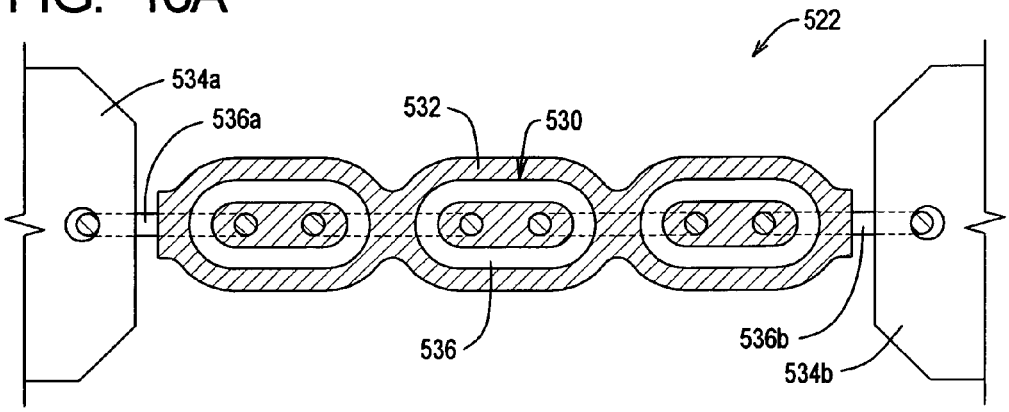
FIGS. 16A–B are side elevation section views of the coupler system depicted in FIG. 15.
Figure 16B:
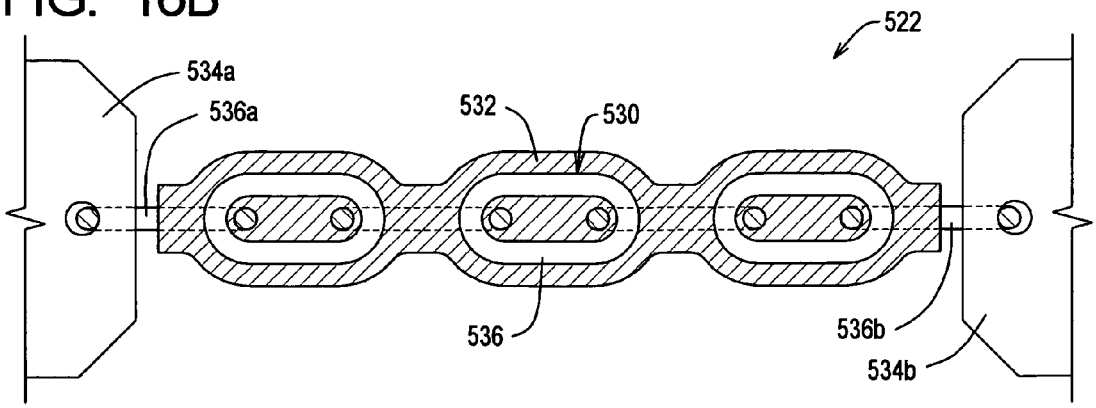

FIGS. 15, 16A, and 16B illustrate a fourth exemplary coupler 520 that may be used as the coupler 30 described above. The coupler 520 comprises a spacing assembly 522 and first and second pin pipes 524 and 526. The spacing assembly 522 comprises a chain assembly 530 that is embedded in or surrounded by a body 532 of elastomeric material and first and second flanges 534*a* and 534*b*. The pin pipes 524 and 526 are made of a rigid material that may be bonded, welded, or otherwise secured to the flanges 534*a* and 534*b*, respectively. The chain assembly 530 conventionally comprises a plurality of links 536. End links 536*a* and 536*b* of the chain assembly 530 extend through holes in the flanges 534*a* and 534*b* to connect the chain assembly 530 between the pin pipes 524 and 526.

The body 532 of elastomeric material maintains the chain assembly 530 in a generally linear shape. The elastomeric material further extends between at least some of the links 536*a* of the chain assembly 530. When tension loads are applied to force the end links 536*a* and 536*b* away from each other, the effective length of the chain assembly 530 increases by compressing the elastomeric material between the links 536 as shown by a comparison of FIGS. 16A and 16B. The elastomeric material will also compress when loads force the flanges 524 and 526 towards each other. Accordingly, the elastomeric material absorbs at least a portion of shocks created by momentary loads on the end links 536*a* and 536*b* that occur, for example, when waves cause adjacent barrier sections 12 to move in opposition to each other.

Figure 17:
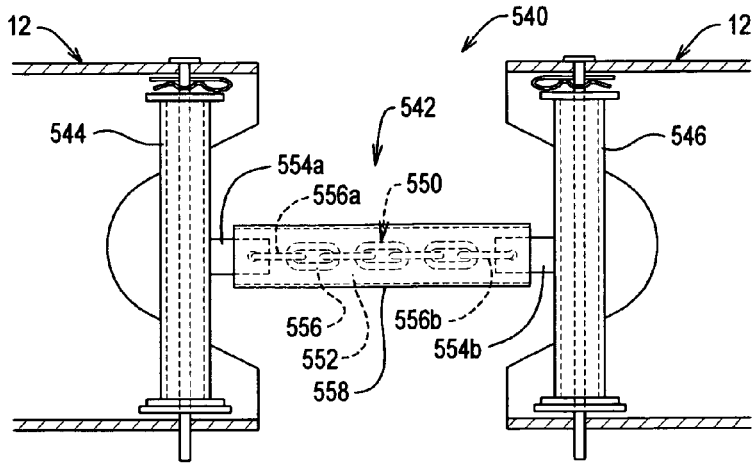
FIG. 17 is side elevation partial section view depicting another alternative coupler system that may be used by the present invention.
Figure 18A:
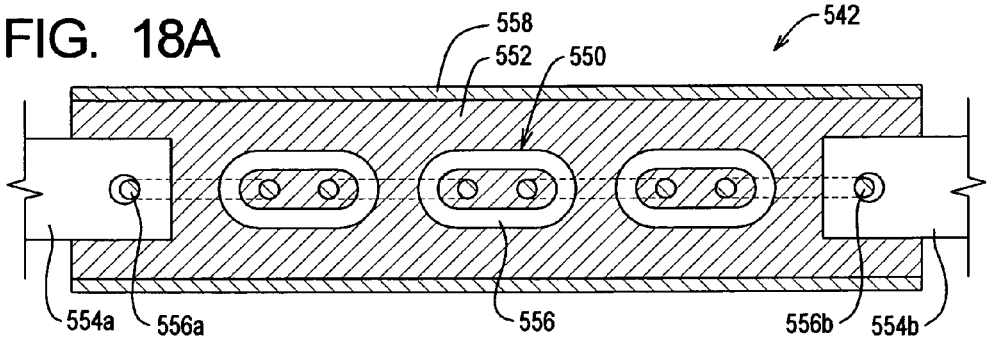
FIGS. 18A–B are side elevation section views of the coupler system depicted in FIG. 17.
Figure 18B:
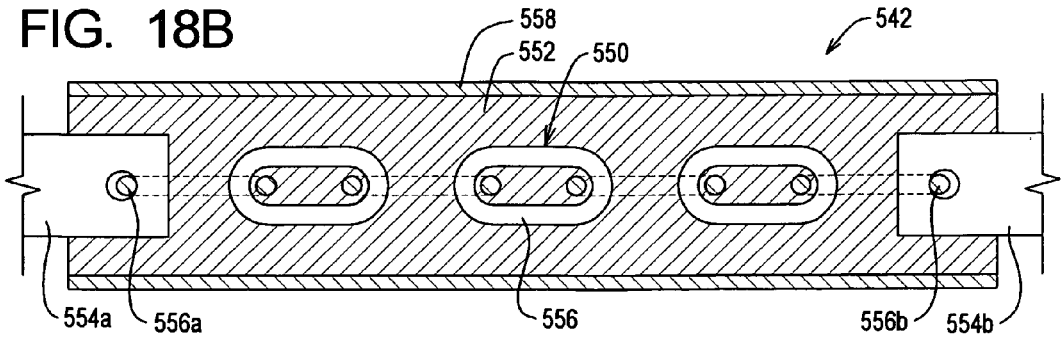

FIGS. 17, 18A, and 18B illustrate a fifth exemplary coupler 540 that may be used as the coupler 30 described above. The coupler 540 comprises a spacing assembly 542 and first and second pin pipes 544 and 546. The spacing assembly 542 comprises a chain assembly 550 that is embedded in or surrounded by a body 552 of elastomeric material and first and second flanges 554*a* and 554*b*. The pin pipes 544 and 546 are made of a rigid material that may be bonded, welded, or otherwise secured to the flanges 554*a* and 554*b*, respectively. The chain assembly 550 conventionally comprises a plurality of links 556. End links 556*a* and 556*b* of the chain assembly 550 extend through holes in the flanges 554*a* and 554*b* to connect the chain assembly 550 between the pin pipes 544 and 546.

The exemplary body 552 of elastomeric material is at least partly surrounded by a sleeve 558. The exemplary sleeve 558 is generally cylindrical. During manufacture, the sleeve 558 forms a mold in which the elastomeric material can be placed or injected around the chain assembly 550. The sleeve 558 can also form a protective barrier for the elastomeric body 552. The body 552 and sleeve 448 maintain the chain assembly 550 in a generally linear shape. As described above, the elastomeric material absorbs at least a portion of shocks created by momentary loads on the end links 556*a* and 556*b* that occur, for example, when waves cause adjacent barrier sections 12 to move in opposition to each other.

Figure 19:
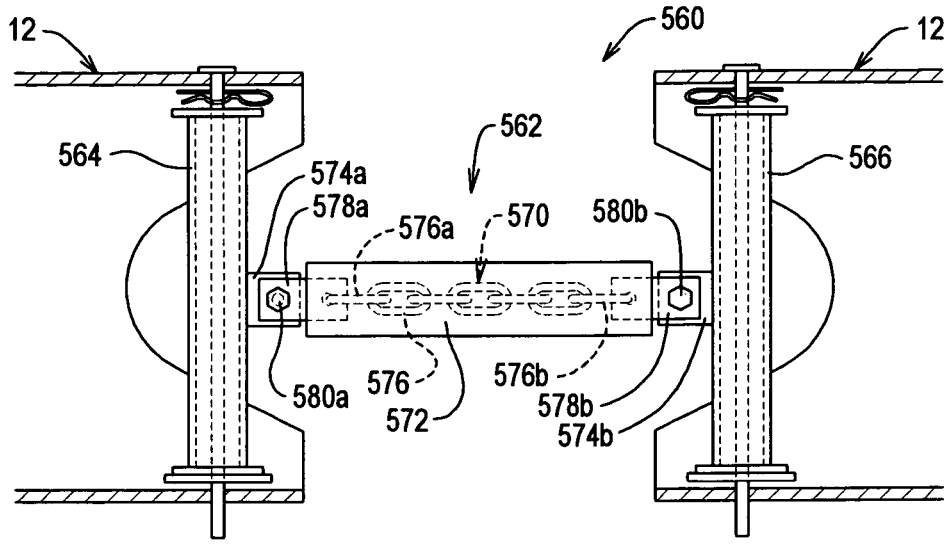
FIG. 19 is side elevation partial section view depicting another alternative coupler system that may be used by the present invention.
Figure 20:
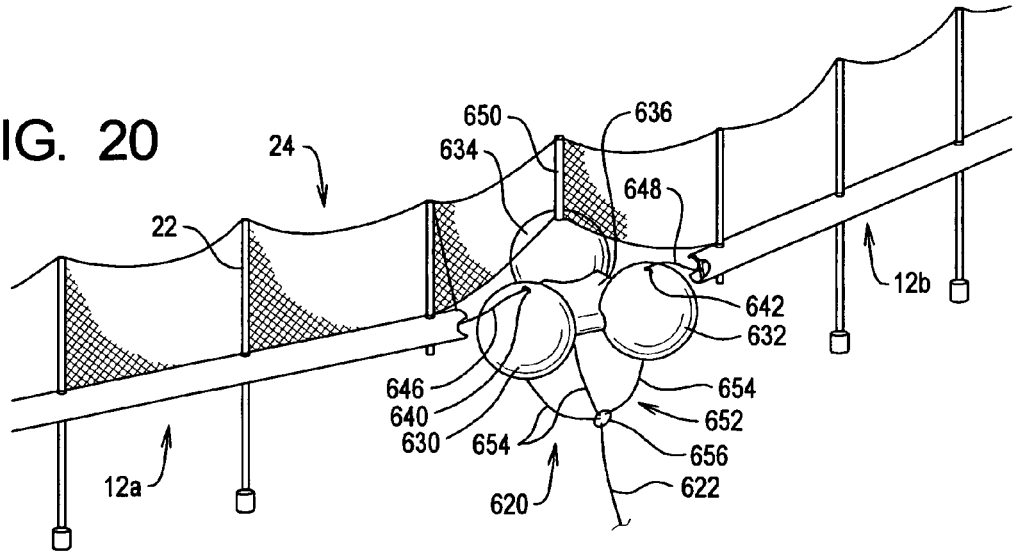
FIG. 20 is a perspective view of a coupling system between two barrier segments.

FIG. 19 illustrates a sixth exemplary coupler 560 that may be used as the coupler 30 described above. The coupler 560 comprises a spacing assembly 562 and first and second pin pipes 564 and 566. The spacing assembly 562 comprises a chain assembly 570 that is embedded in or surrounded by a body 572 of elastomeric material and first and second flanges 574*a* and 574*b*. The pin pipes 564 and 566 are made of a rigid material that may be bonded, welded, or otherwise secured to the flanges 574*a* and 574*b*, respectively. The body 572 of elastomeric material may take the form of the bodies 532 and/or 552 described above.

The chain assembly 570 conventionally comprises a plurality of links 576 and first and second end plates 578*a* and 578*b*. End links 576*a* and 576*b* of the chain assembly 570 extend through holes in the end plates 578*a* and 578*b*. Bolt assemblies 580*a* and 580*b* extend through holes in the end plates 578*a* and 578*b* and in the flanges 574*a* and 574*b*, respectively. The bolt assemblies 580*a* and 580*b* connected the chain assembly 570 between the pin pipes 564 and 566. However, the bolt assemblies can be removed and replaced to allow the spacing assembly 562 to be assembled or repaired by hand if necessary.

FIGS. 20, 21A, 21B, and 21C illustrate a seventh exemplary coupler 620 that may be used in place of the coupler 30 described above. The coupler 620 connects together two barrier sections 12 and further allows the barrier system 10 to be secured to an underwater cable 622. The cable 622 may be secured to the ocean floor and/or any other convenient device or location such as an anchor or the like.

The coupler 620 comprises at least one floatation device; the exemplary coupler 620 comprises first, second, and third flotation devices 630, 632, and 634, although one, two, four, or more flotation devices may be used. The exemplary flotation devices 630, 632, and 634 are connected by a generally triangular platform 636. Eyelets 640 and 642 are formed on the first and second flotation devices 630 and 632, while a post projection 644 is formed on the third flotation device 634.

The eyelets 640 and 642 are adapted to be connected to the barrier sections 12*a* and 12*b*, respectively. As one example, the connection between the eyelets 640 and 642 and the barrier sections 12*a* and 12*b* may be formed by lines 646 and 648 that are connected to the eyelets 640 and 642 at one end and the barrier sections 12*a* and 12*b* at the other end. In this case, a structure such as the pin pipe 564 and flange 574 may be used at each barrier section 12. The lines 646 and 648 may be passed through or otherwise secured to the holes in the flanges 574.

Figure 21A:
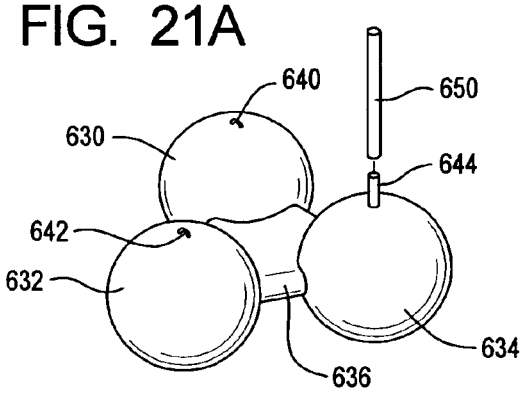
FIGS. 21A–C are perspective, top plan, and rear elevation views of the coupling system of FIG. 20.
Figure 21B:
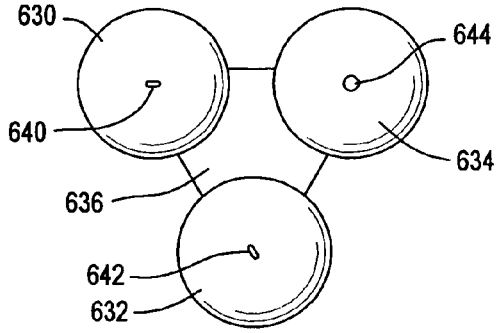
Figure 21C:
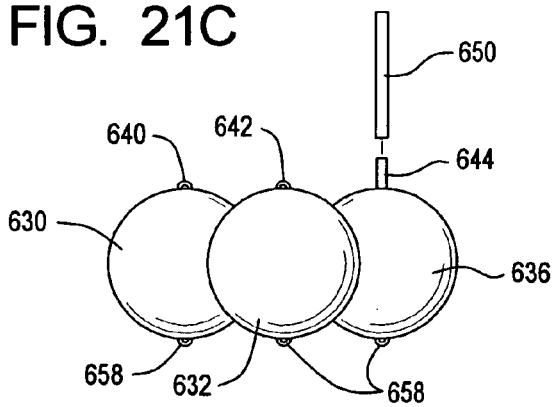

As perhaps best shown in FIGS. 21A and 21C, the post projection 644 is designed to support a lower end of a post 650. The post 650 extends into or, as shown, receives the post projection 644. The function of the post 650 is similar to the post systems 22 described above. The post 650 supports a net system such as the net system 24 described above as the net system extends from one barrier section 12 to another.

The platform 636 is connected between the flotation devices 630, 632, and 634 such that the eyelets 640 and 642 and the post projection 644 extend in the same direction. A harness assembly 652 comprises one or more harness lines 654 and a harness ring 656. The harness lines 654 are connected between eyelets 658 (FIG. 21C) on the underside of one or more of the flotation devices 630, 632, and/or 634 and the harness ring 656. The harness ring 656 is in turn connected to the underwater line 622 to form a secure attachment between the line 622 and the coupler 620.

Figure 22:
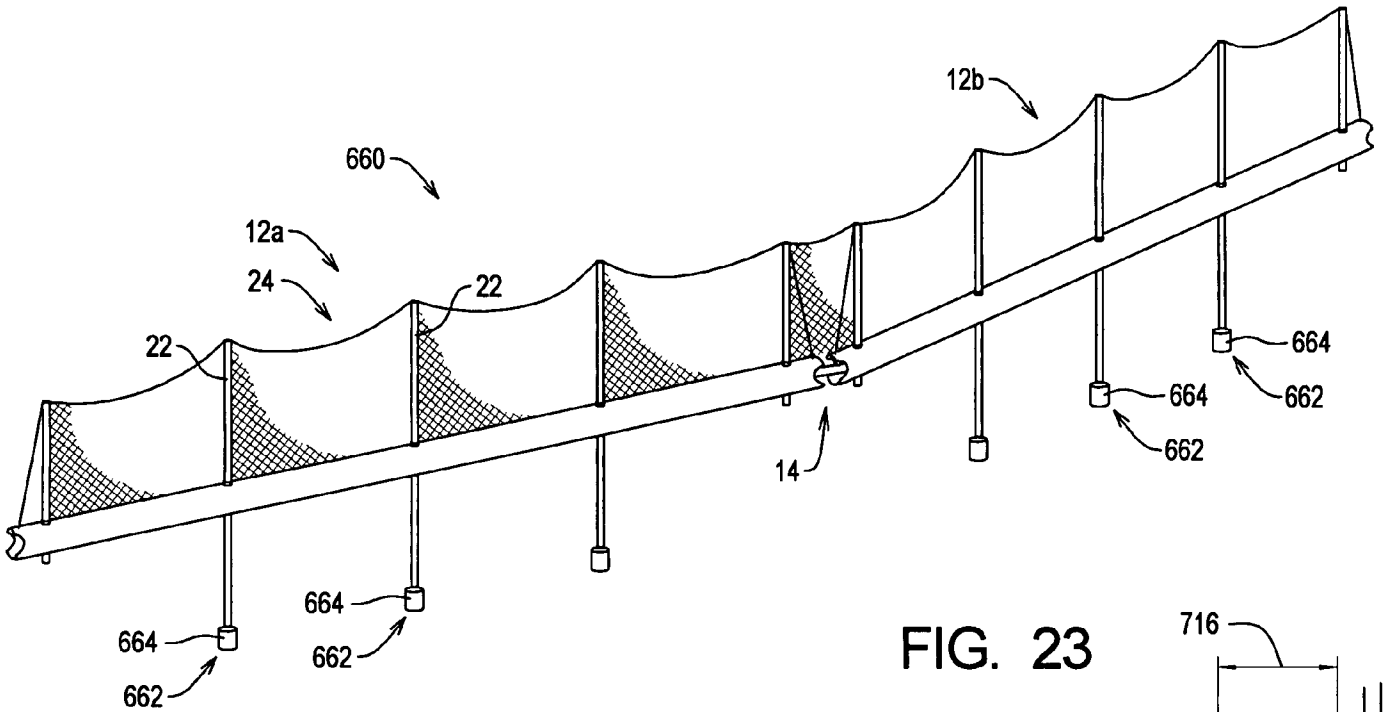
FIG. 22 is a perspective view of a barrier system of the present invention employing a simplified stabilizing system.

Referring now to FIG. 22, depicted therein is another example of a marine barrier system 660 similar to the marine barrier system 10. The barrier system 660 comprises a stabilizing system 662 comprising only a ballast system 664 like the ballast system 112 described above but no keel system like the keel system 110 of the barrier system 10. In all other respects, the barrier system 660 is constructed and operated in a manner similar to the barrier system 10 describe above.

Figure 23:
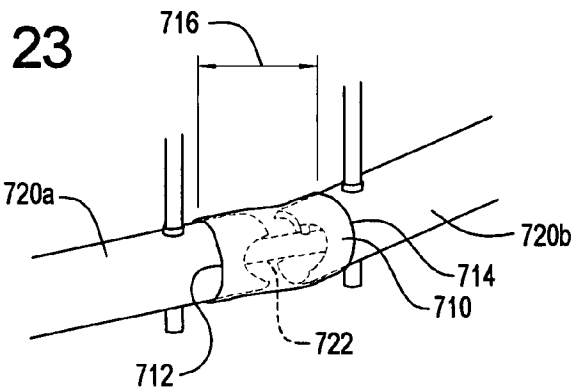
FIG. 23 is a perspective view perspective view of a coupler sleeve that may be used by a number of coupler systems used by the exemplary barrier systems of the present invention.

Referring now to FIG. 23, depicted therein is a coupling sleeve 710 that may be used with any of the coupling systems described above. The coupling sleeve 710 is a sheet of material formed in a closed shape that defines first and second openings 712 and 714 and an effective length 716. The sleeve 710 extends between adjacent float pipes 720*a* and 720*b* over a coupler 722. In particular, the end of the float pipe 720*a* is inserted into the first opening 712 and the end of the float pipe 720*b* is inserted into the second opening 714. The effective length 716 is set to span the distance between the ends of the float pipes 720*a* and 720*b*. The coupling sleeve 710 thus reduces access to the coupler 722.

The sleeve 710 may be secured by screws, bolts, adhesives, Velcro, snap fasteners, hooks, or the like to the ends of the float pipes 720*a* and 720*b*. In addition, the sleeve 710 is preferably made of a material that is somewhat flexible so that movement of the float pipes 720 relative to each other does not break, rip, or otherwise dislodge the sleeve from the ends of the pipes 720. For example, the sleeve 710 is made of a rectangular sheet of flexible fabric that is sewn along two edges. The sleeve 710 so formed may be arranged in a cylindrical shape having approximately the same diameter as the float pipes 720.

Figure 24:
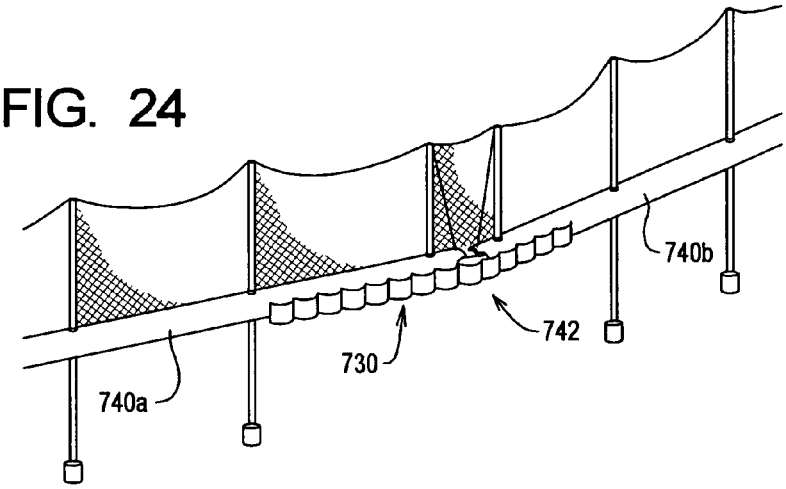
FIG. 24 is a perspective view of a boom liner that may be secured to adjacent barrier segments of the present invention.

Referring now to FIG. 24, depicted therein is a boom liner 730 that may be used with any of the coupling systems described above. The boom liner 730 is an elongate structure that is fastened to adjacent float pipes 740*a* and 740*b* to bridge a gap between the pipes 740*a* and 740*b* at a coupler 742. In particular, the boom liner 730 is connected to one end of the float pipe 740*a* and to one end of the float pipe 740*b* and spans the distance between the ends of the float pipes 740*a* and 740*b* on one side of a coupler 742 between the float pipes 740. While the boom liner 730 is shown extending only partly along the float pipes 740 in FIG. 24, the boom liner may be fabricated to extend along the entire length of the float pipes 740 and thus the entire barrier system formed by these pipes 740. The boom liner 730 forms a barrier to oil and/or other liquids floating on the surface of the water. The boom liner 730 is preferably formed of a material that is flexible and inert to crude oil, diesel oil, gasoline, and other materials that may need to be contained.

Figure 25:
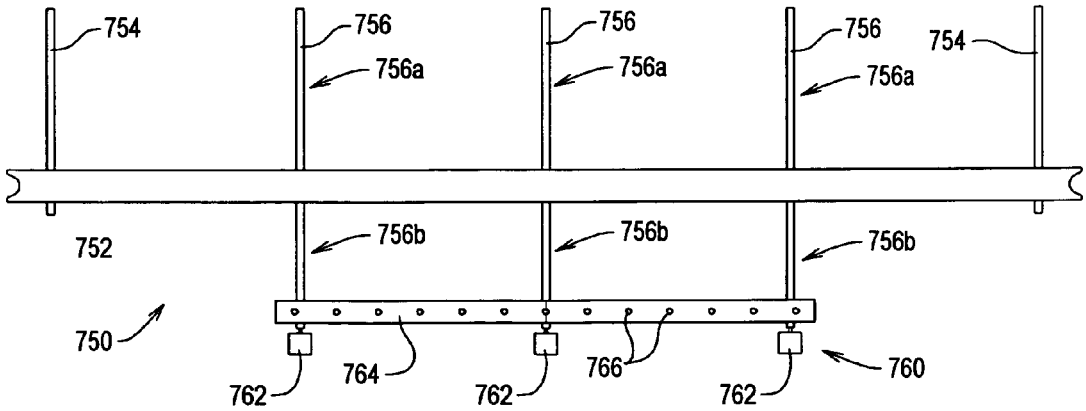
FIG. 25 is a front elevation view of a barrier system of the present invention with yet another exemplary stabilizing system.

FIG. 25 illustrates an alternative exemplary barrier segment 750 embodying the principles of the present invention. The barrier segment 750 comprises a float pipe 752, a plurality of end posts 754, and a plurality of intermediate posts 756. The end posts 754 are supported by the float pipe 752 such that the end posts extend above the float pipe 752 during normal use. The intermediate posts 756 comprise upper portions 756*a* and lower portions 756*b* that extend above and below, respectively, the float pipe 752 during normal use. A fence or other barrier may be supported by the end posts 754 and the upper portions 756*a* of the intermediate posts 756 as generally described above.

The barrier segment 750 further comprises a stabilizing system 760 comprising ballast members 762 and a keel member 764. The ballast members 762 are weights that, during normal use, maintain the barrier segment 750 in an upright configuration. The exemplary keel member 764 extends between the lower portions 756*b* of the intermediate posts 756 just above the ballast members 762. In addition, the exemplary keel member 764 is a hollow pipe with holes 766 formed therein. The keel member 764 dampens movement of the barrier segment 750 in rough water.

FIGS. 26–30 illustrate yet another exemplary coupler system 810 that may be used as the coupler system 14 described above. The coupler system 810 comprises a coupler 812 and first and second coupler pins 814 and 816. The coupler system 810 joins together barrier sections 818*a* and 818*b* that are or may be the same in most respect to any of the barrier sections described above.

Figure 26:
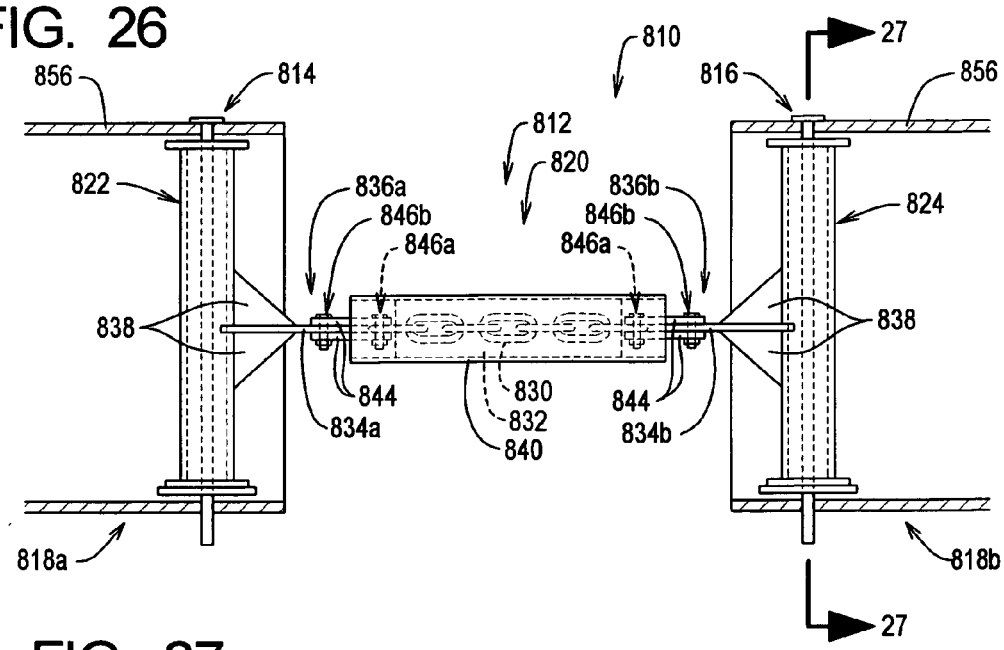
FIG. 26 is side elevation partial section view depicting another alternative coupler system that may be used by the present invention.

The coupler 812 comprises a spacing assembly 820 and first and second pin pipes 822 and 824. As perhaps best shown in FIG. 30, the spacing assembly 820 comprises a chain assembly 830, a body 832 of elastomeric material, first and second flanges 834*a* and 834*b*, and first and second connecting assemblies 836*a* and 836*b*. As shown in FIG. 26, the pin pipes 822 and 824 are made of a rigid material that may be bonded, welded, or otherwise secured to the flanges 834. Braces 838 extend between the pin pipes 822 and 824 and the flanges 834.

Figure 30:
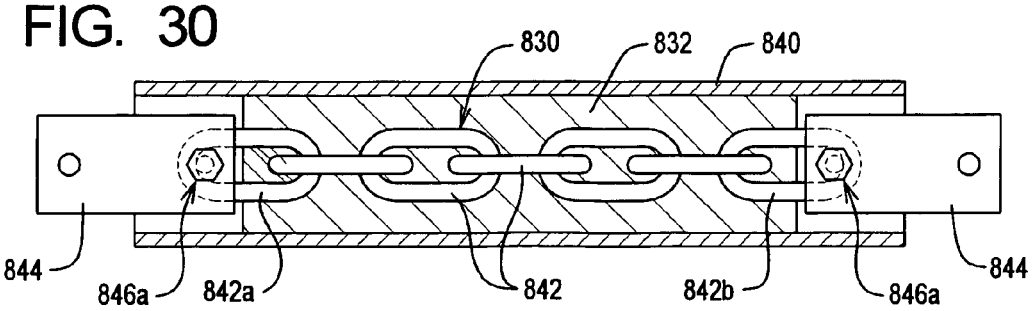
FIG. 30 is a section view of a portion of the coupler assembly of the present invention as depicted in FIGS. 26–29.

As perhaps best shown in FIG. 30, the exemplary body 832 of elastomeric material is at least partly surrounded by a sleeve 840 similar to the sleeve 558 described above. The chain assembly 830 is conventional in that it comprises a plurality of links 842. End links 842*a* and 842*b* of the chain assembly 830 extend out of the elastomeric body 832. As described above, the elastomeric material absorbs at least a portion of shocks created by momentary loads on the end links 842*a* and 842*b* that occur when the adjacent barrier sections 12 to move in opposition to each other.

The connecting assemblies 836 each comprise first and second connecting plates 844 and a pair of bolt assemblies 846*a* and 846*b*. The bolt assemblies 846*a* and 846*b* extend between the connecting plates 844 and pass through the end links 842*a* and 842*b* and holes in the flanges 834*a* and 834*b*, respectively. So assembled, the connecting assemblies 836 connect the chain assembly 830 to the flanges 834*a* and 834*b* to allow substantial vertical and some lateral movement between the barrier sections 818.

Figure 28:
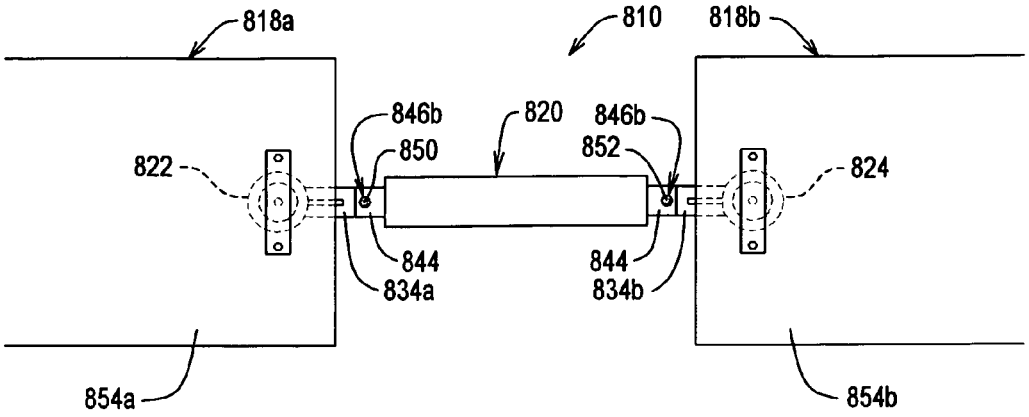
FIGS. 28 and 29 are top plan views of the coupler system 26 in first and second configurations.
Figure 29:
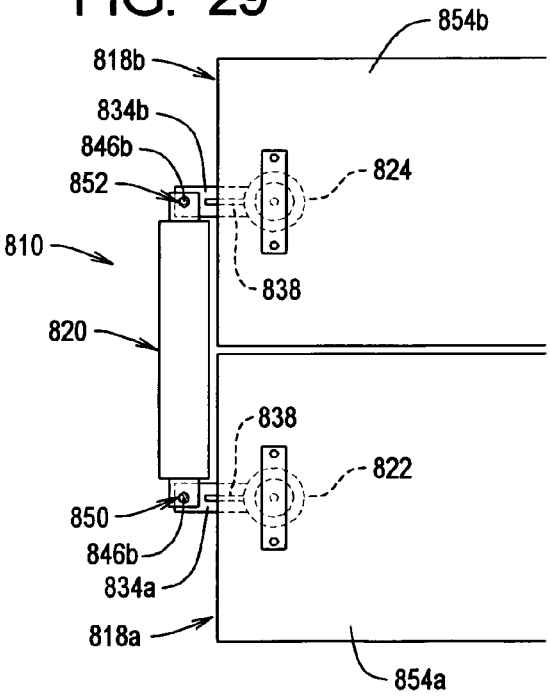

Referring now to FIGS. 28 and 29, depicted therein are top elevation views that illustrate the coupler system 810 in first and second configurations. These configurations illustrate one half of a range of movement between the barrier sections 818*a* and 818*b* allowed by the coupler system 810. FIGS. 28 and 29 illustrate that the flanges 834*a* and 834*b* are sized and dimensioned such that pivot points 850 and 852 defined by the coupler system 810 are spaced beyond the ends of float pipes 854*a* and 854*b* forming parts of the barrier segments 818*a* and 818*b*. The float pipes 854 each define a float pipe wall 856. In addition, the chain assembly 830 and connecting plates 844 are sized and dimensioned such that a distance between the pivot points 850 and 842 is slightly larger than a diameter of the float pipes 854.

The coupler system 810 thus allows the barrier segments 818*a* and 818*b* to be folded back into an adjacent, parallel storage position as shown in FIG. 29; the coupler system 810 would also allow the barrier segments 818*a* and 818*b* to be folded into a similar storage position opposite that shown in FIG. 29 (segment 818*a* above the segment 818*b* when viewed from the perspective of FIG. 29). The use of the coupler system 810 thus allows the segments 818 to be placed in a storage configuration without the use of notches formed in the float pipes 854 as described above with reference to FIG. 6. The coupler system 810 further allows the barrier segments 818 to extend at virtually any angle with respect to each other during normal use.

Figure 27:
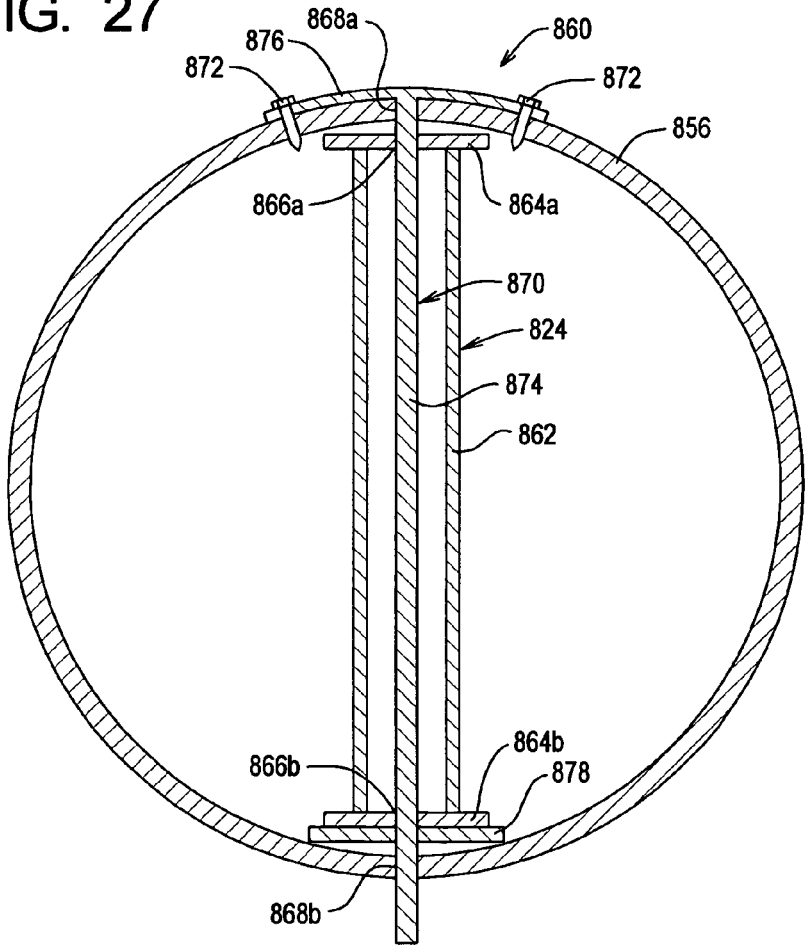
FIG. 27 is a side elevation section view of the coupler system taken along lines 27—27 in FIG. 26.

Referring now to FIG. 27, depicted therein is a pin assembly 860 that may be used to connect the pin pipes 822 and 824 to the float pipes 854*a* and 854*b*, respectively. The exemplary pin pipes 822 comprise a hollow tube 862 and upper and lower end plates 864*a* and 864*b*. Holes 866*a* and 866*b* are formed in the end plates 864*a* and 864*b*, respectively. Corresponding holes 868*a* and 868*b* are formed in the float pipe 854. The pin assembly 860 comprises a pin member 870 and one or more pin fasteners 872. The pin member 870 comprises pin shaft 874 and pin plate 876. The length of the pin shaft 874 is greater than a diameter of the float pipes 854.

In use, the pin member 870 is displaced such that the pin shaft 874 extends through the holes 868*a*, 866*a*, 866*b*, and 868*b* in sequence until the pin plate 876 engages a wall 856 of the float pipe 854. The pin fasteners 872 fasten the pin plate 876, and thus the pin member 870, relative to the float pipe 854. A pin bearing plate 878 may be arranged below the lower pin end plates 864*b* to reduce wear on the float pipe wall 856.

The pin fasteners 872 can take any one of a number of forms. For example, screws, nails, rivets, snap fasteners or the like may be passed through the pin plate 876 and the float pipe wall 856 to secure the pin plate 876 to the wall 856. If nails are used as the fasteners as shown, the nails can be configured to extend at angles to each other to resist pull out when upward loads are applied to the pin members 870. To this end, the pin plate 876 may be curved such that it conforms to the curvature of the float pipe wall 856. Alternatively, adhesives, hook and loop fasteners, or other types of fasteners that do not penetrate the float pipe wall 856 may be used as the fasteners 872.

Figure 31:
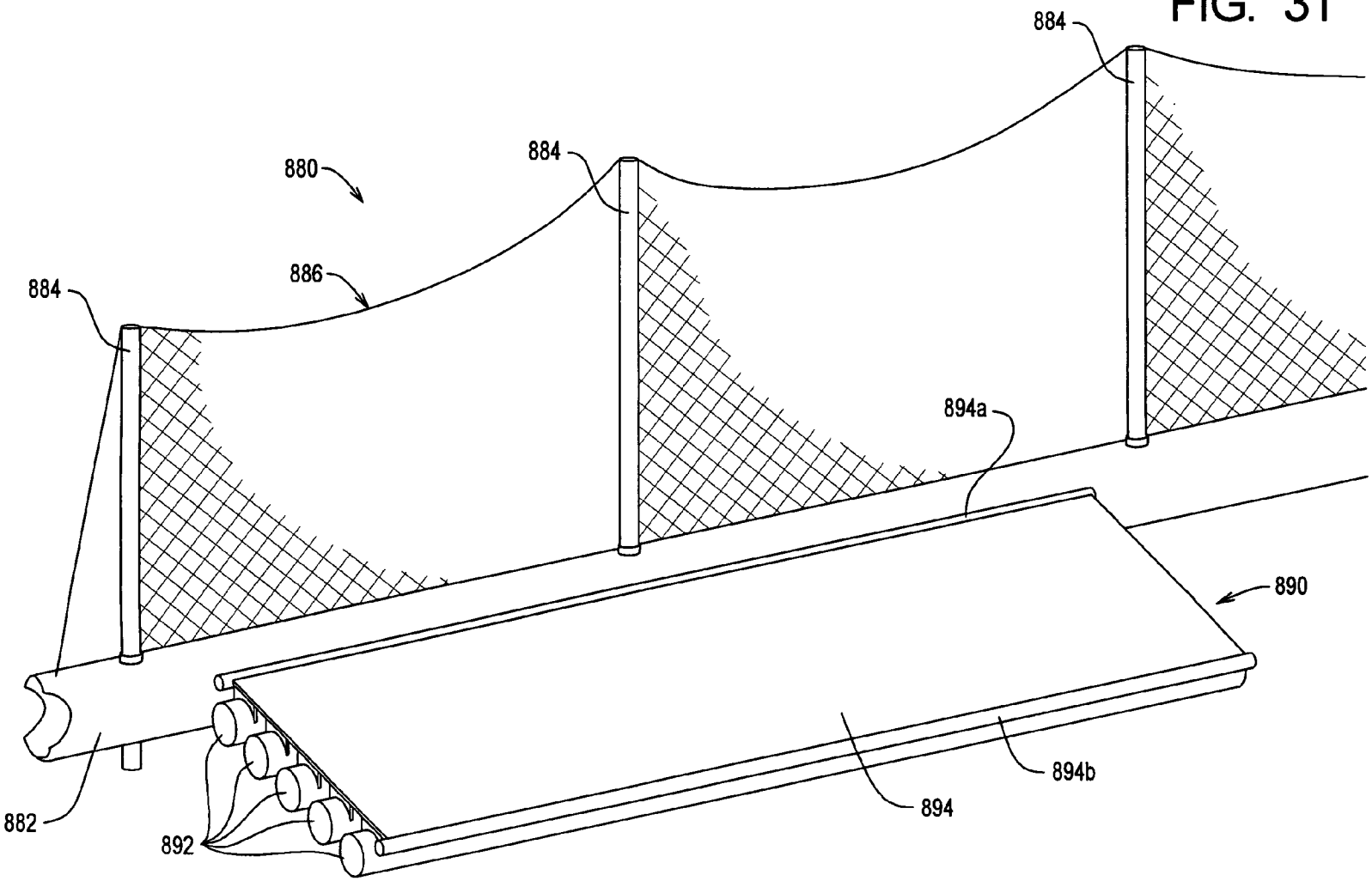
FIG. 31 is a perspective view of a barrier segment of the present invention having a raft module attached thereto.

Turning now to FIG. 31, depicted therein is yet another exemplary barrier segment 880 that may be used in place of, or in conjunction with, the barrier segments described above. The barrier segment 880 comprises a float pipe 882 and may comprise a plurality of net posts 884 and a net system 886. The barrier segment 880 may also include a stabilizing system (not shown) as described above.

The barrier system 880 further comprises a raft module 890 comprising a plurality of flotation members 892 and a raft platform 894. The flotation members 892 provide sufficient buoyancy to the raft module 890 such that a predetermined load may be supported by the raft platform 894. Typically, but not necessarily, the flotation members 892 are similar to the float pipes described herein in that they are elongate pipes filled with buoyant material. The raft platform 894 is a single sheet or plurality of planks sufficient to support the predetermined load and maintain the flotation members 892 in place.

The raft module 890 further comprises inner and outer rails 894*a* and 894*b* secured to and extending at least partly along opposite edges of the raft platform 894. The inner rail 894*a* is secured to the float pipe 882. The exemplary rails 894 are substantially the same, which allows the raft module 890 to be placed in any direction relative to and/or on both sides of the barrier segment 880.

The raft module 890 facilitates repairs to the barrier segment or segments 880 forming the entire barrier system. The raft module 890 further allows the posting of sentries and/or the placement of equipment for detecting attempts to breach the barrier system.

Referring now to FIGS. 32–36, depicted at 920 therein is yet another example barrier system constructed in accordance with, and embodying, the principles of the present invention. The barrier system 920 comprises a plurality of barrier segments 922 connected together using a connecting system 924.

Figure 32:
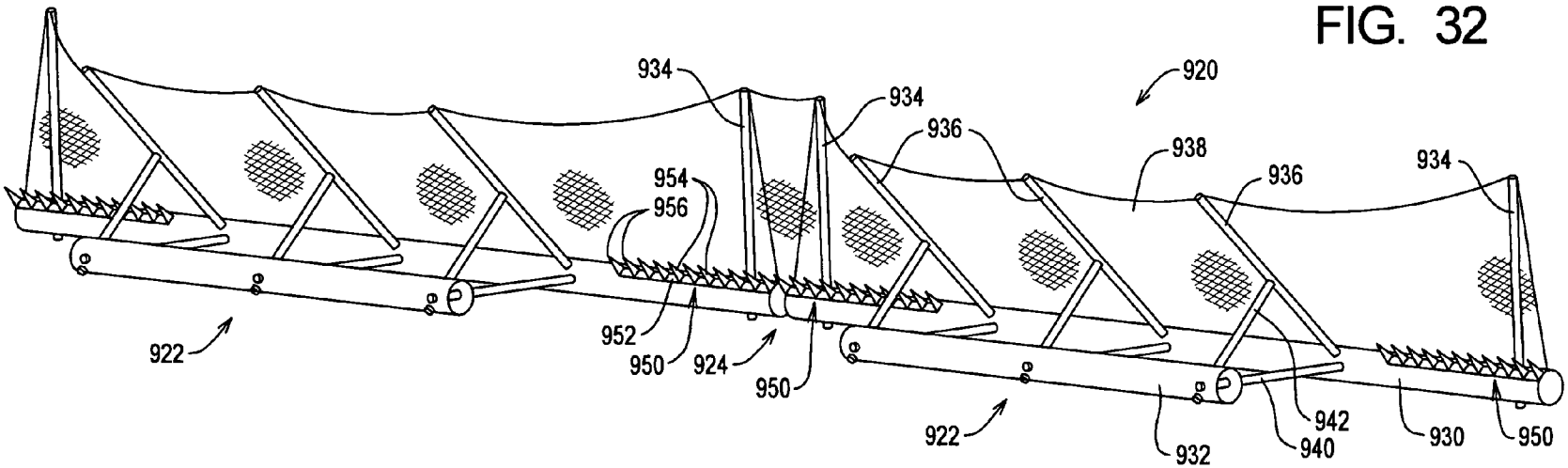
FIG. 32 is a perspective view of yet another example barrier system constructed in accordance with the principles of the present invention.

As shown in FIG. 32, the barrier segments 922 comprise at least one main flotation member 930 and at least one outrigger flotation member 932. Extending from the main flotation member assembly 930 are at least one upright post 934 and at least one canted post 936. A fence 938 is supported by the posts 934 and 936.

FIG. 32 also illustrates that the barrier segments 922 further comprise a plurality of spacing members 940 and a plurality of bracing members 942. The spacing members 940 extend between the main flotation member 930 and the outrigger flotation member 932. The bracing members 942 are arranged to support the canted posts 936. The spacing members 940 maintain the main flotation member 930 and the outrigger flotation member 932 in a parallel, substantially fixed relationship. The bracing members support the canted posts 936 in an angled, substantially fixed relationship with the main and outrigger flotation members 930 and 932.

Figure 33:
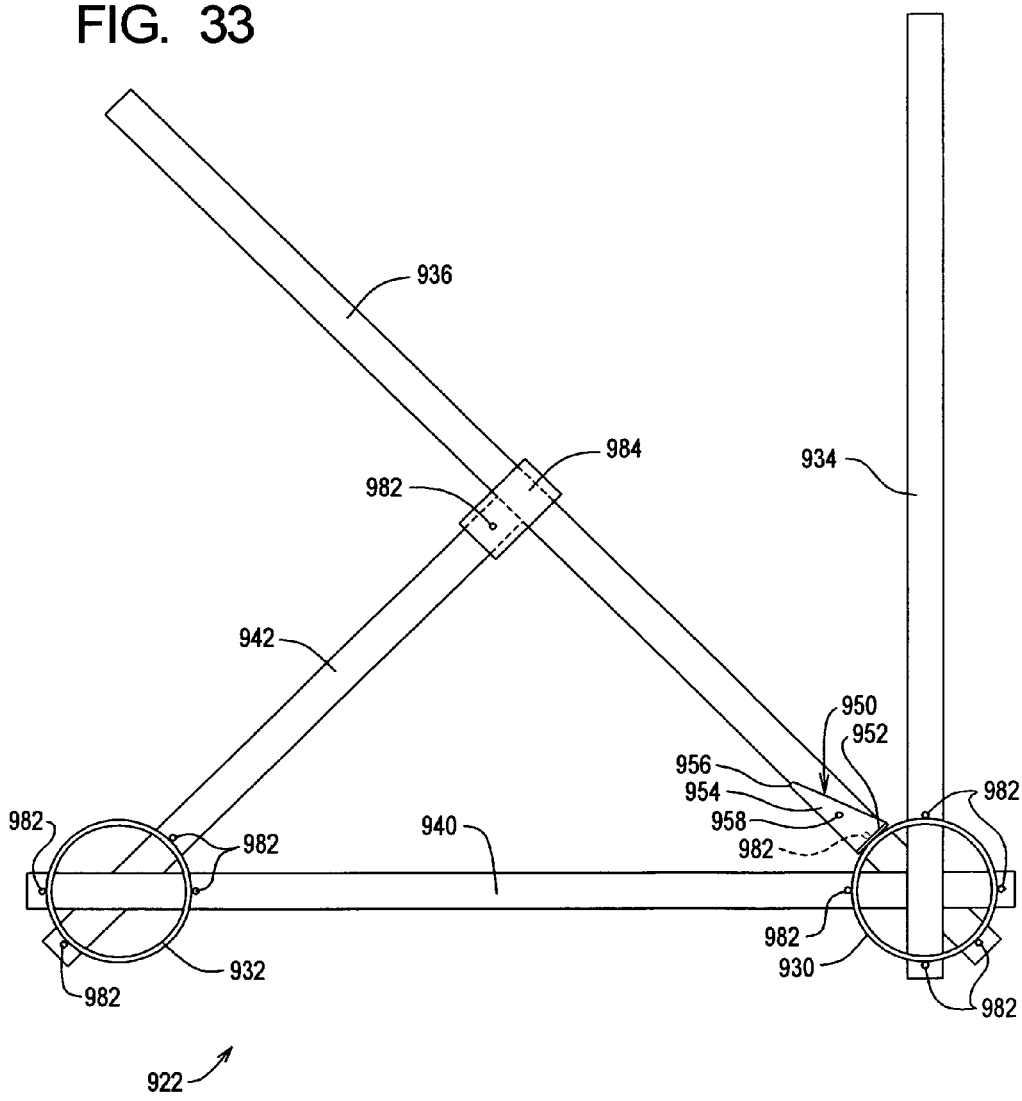
FIG. 33 is a side elevation view of a barrier segment of the barrier system of FIG. 32.

As shown in FIG. 33, the bracing members 942 of the example barrier segments 922 extend between the canted posts 936 and the outrigger flotation member 932. The spacing members 940 are substantially horizontal and the upright posts 934 are substantially vertical. The canted posts 936 extend at an angle of approximately 45 degrees from horizontal. The example bracing members 942 extend substantially at a right angle to the canted posts 936. These angles are determined when the barrier segment is oriented for normal use and stationary. The angles described above are included herein as examples only, and any angles may be used that allow the barrier segments 922 to function as described below.

The upright posts 934 are located at the ends of the main flotation members 930 adjacent to the connecting system 924. The use of upright posts 934 instead of the canted posts 936 allows access to the connecting system 924 from either side of the barrier system 920.

Figure 36:
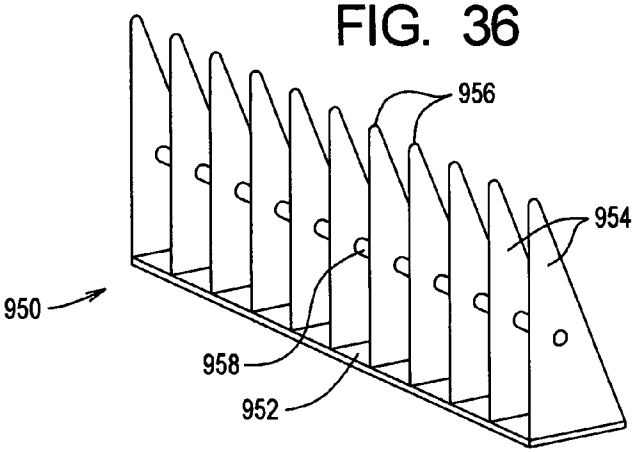
FIG. 36 is a perspective view of an optional piercing strip that may be used by the barrier segments described above.

The upright posts 934 may, however, provide less protection, and optional piercing strips 950 may be secured to ends of the main flotation members 930 adjacent to the connecting system 924. As shown in FIG. 36, the example piercing strips 950 comprise a backing plate 952 and at least one piercing plate 954. The backing plate 952 is bolted or otherwise secured to the main flotation members 930 such that points 956 defined by the piercing plates 954 are directed away from the restricted area defined by the barrier system 920. A stabilizing bar 958 may be secured to the plates between the backing plate 952 and the tips 956.

During use, the flotation members 930 and 932 maintain the posts 934 and 936 in substantially vertical and canted positions as described above. The posts 934 in turn support the fence 938 such that movement of vessels and people across the barrier segments 922 is impeded. Typically, the canted posts 936 are angled outwardly away from the vessel or other installation being protected by the barrier system 920.

The barrier system 920 serves several functions. First, the barrier system 920 is highly visible and clearly identifies restricted areas. Vessels with good intent will not inadvertently move into such restricted areas.

Second, the barrier system 920 will prevent many vessels with bad intent from crossing into restricted areas. In particular, the barrier segments 922 will prevent smaller, relatively lightweight vessels from moving across the barrier line defined by the barrier system 920. Larger vessels will easily breach the barrier system 920, but larger vessel tend to move more slowly and are easier to detect using other means such as lookouts or radar.

The fence 938 supported by the posts 934 and 936 is typically a metal or plastic mesh material that inhibits movement of people and/or vessels over the barrier segments 922. Where the fence 938 is supported by the canted posts 936, approach to the barrier line is limited by the outrigger flotation members 932. In addition, a vessel moving over the outrigger flotation members 932 will next encounter the canted posts 936 and the fence 938 supported thereby. The posts 936 and portion of the fence 938 supported thereby will direct the bow of the vessel down and reduce the likelihood that a vessel will move over the main flotation members 930 and beyond the barrier line into the restricted area.

Where the fence 938 is supported by the upright posts 934, access to the main flotation members 930 is not restricted by the outwardly canted portion of the fence 938 or the outrigger flotation members 936. The use of the optional piercing strips 950 adjacent to the upright posts 934 can provide additional protection by damaging a craft attempting to breach the barrier system 920 near the connecting system 924.

The barrier system 920 is thus capable of preventing movement of many types of vessels across the barrier line and will, in any event, typically slow down a vessel attempting to cross the barrier line.

Figure 34:
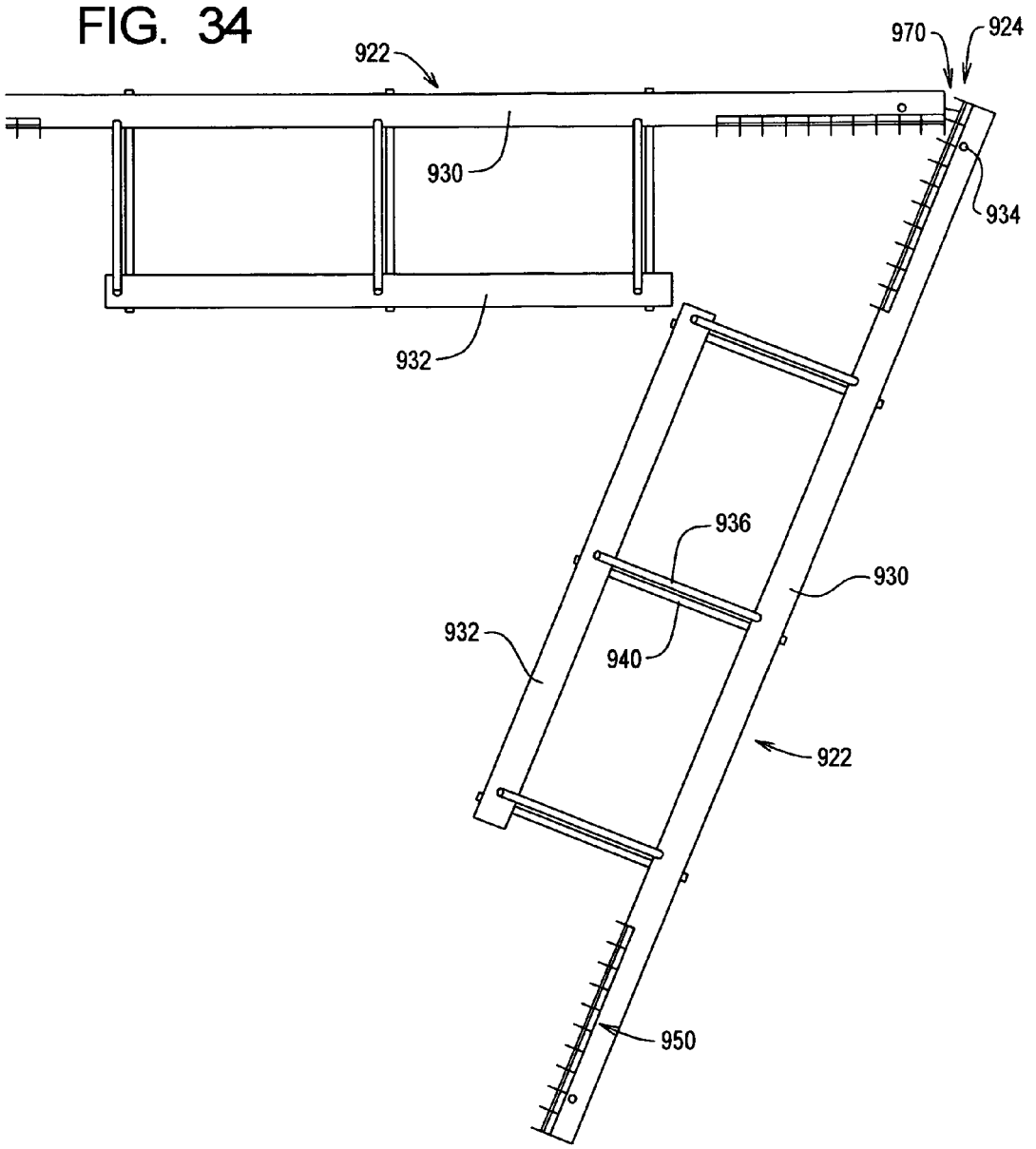
FIG. 34 is a top plan view of the barrier system of FIG. 32.

The barrier segments 922 and connecting system 924 are configured to allow significant flexibility in the construction and placement of the barrier system 920. In particular, the outrigger flotation members 932 are shorter than the main flotation members 930. Adjacent barrier segments 922 thus may be configured as shown in FIG. 34 such that an outer angle between the adjacent segments 922 is less than 90 degrees without interference between the outrigger flotation members 932.

Figure 35:
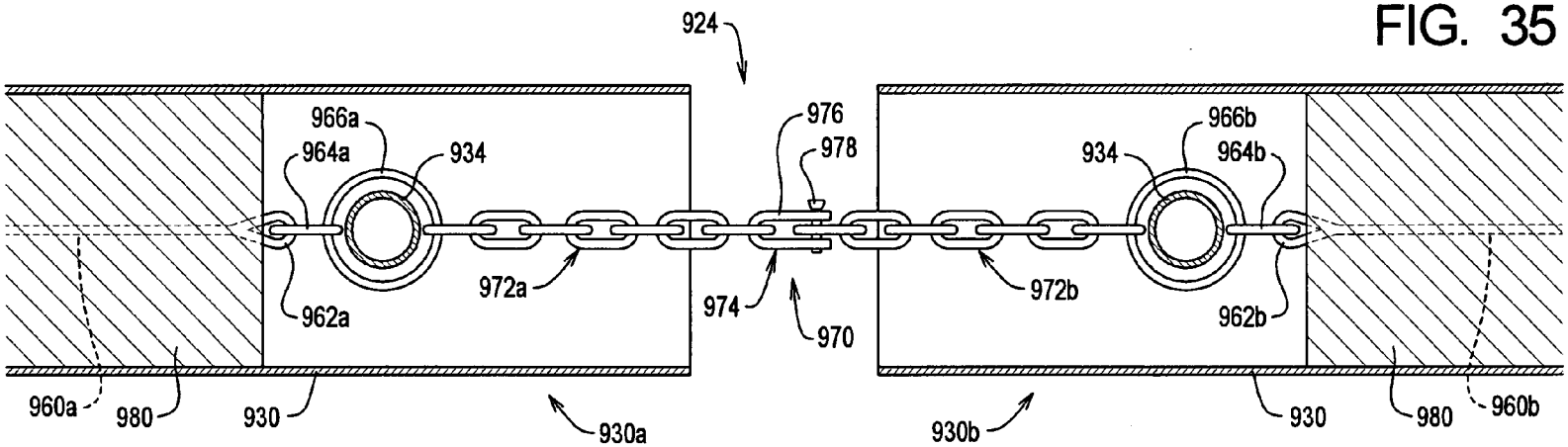
FIG. 35 is a front elevation, cut-away view of a connecting system used by the barrier system of FIG. 32.

The connecting system 924 is depicted in further detail in FIG. 35. In particular, FIG. 35 depicts the connected ends of first and second adjacent main flotation members 930*a* and 930*b*, respectively. The connection system 24 comprises a first cable 960*a* associated with the first pipe 930*a* and a second cable 960*b* associated with the second pipe 930*b*. The cables 960 extend through the entire length of the flotation members 930.

At the ends of the cables 960*a* and 960*b* are loops 962*a* and 962*b*. Cable rings 964*a* and 964*b* extend through the loops 962*a* and 962*b*, respectively, to provide a secure attachment point to the ends of the cables 960*a* and 960*b*, respectively. First and second intermediate rings 966*a* and 966*b* are connected to the cable rings 964*a* and 964*b*. The example cable rings 964 and intermediate rings 966 are sized, dimensioned, and located such that the upright posts 934 extend through the intermediate rings 966 during normal use of the barrier system 920.

A chain assembly 970 extends between the intermediate rings 966. In particular, the chain assembly 970 comprises first and second chain segments 972*a* and 972*b* connected to the intermediate ring 966*a* and 966*b*, respectively. A coupler assembly 974 couples the first and second chain segments 972*a* and 972*b* together. The example coupler assembly 974 comprises a U-shaped coupler 976 and a bolt assembly 978. A lock or other security device may be substituted for the bolt assembly 978.

Figure 34A:
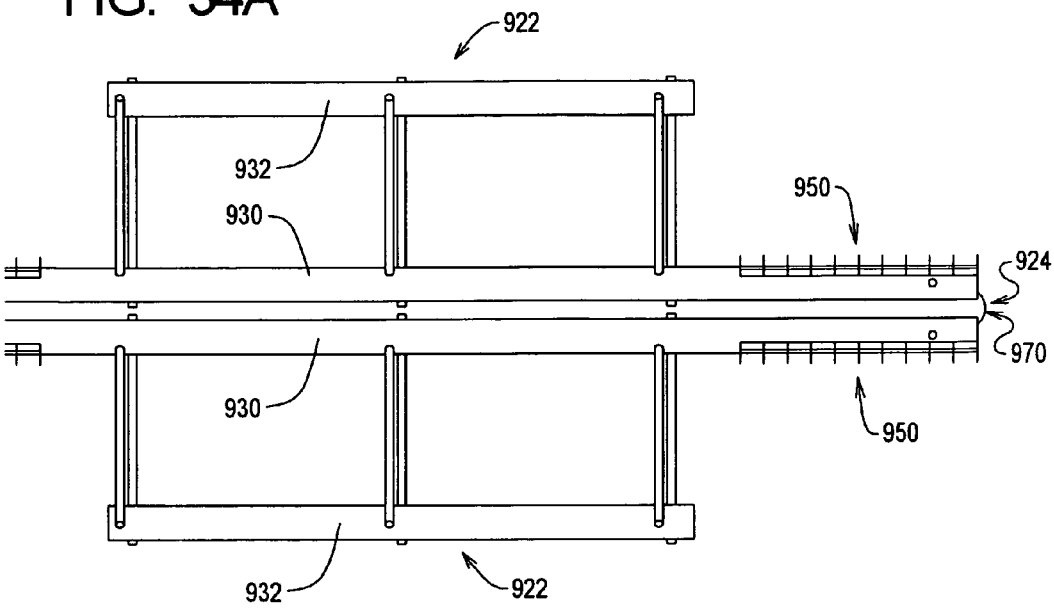
FIG. 34A is a top plan view of the barrier system of FIG. 32 showing a storage configuration in which the first and second main floatation members are arranged in a parallel, side by side arrangement.

With the connection system 924 as described above, a rigid, continuous connection formed of cable and chain extends along the entire length of the barrier system 920. The connection system 924 thus strengthens the barrier system 920. However, the chain assembly 970 allows the segments 922 to be disconnected when necessary. The chain assembly also allows the segments 922 to be angled relative to each other as described above and shown in FIG. 34 and to be in a storage configuration in which the first and second main floatation members are arranged in a parallel, side by side arrangement as shown in FIG. 34A.

Referring for a moment back to FIG. 35, depicted at 980 therein is buoyant material that is inserted, injected, poured, or otherwise placed into the main flotation member 930. Similar buoyant material is typically placed within the outrigger flotation members 932.

FIG. 33 illustrates one example method of connecting the various posts 934 and 936 and members 940 and 942 to the flotation members 930 and 932. In particular, the example posts or members are pipes, and the posts 934 and 936 and members 940 and 942 have smaller diameters than the example members 930 and 932. A pair of opposing holes are formed in the flotation members for each post or member. The posts or members are passed through the opposing holes. As shown in FIG. 33, pins 982 are passed through pairs of opposing holes in the posts or members on either side of the flotation members to prevent movement of the posts or members relative to the flotation members.

Where the example bracing members 942 are connected to the example canted posts 936, a coupling sleeve 984 is used because the diameters of the bracing members 942 and posts 936 are substantially the same. The bracing members 942 are inserted into the coupling sleeves 984 and secured by pins 982. The canted posts 936 are inserted through the coupling sleeves 984 and held in place by the triangular configuration formed by the spacing members 940, bracing members 942, and canted posts 936.

The barrier segments 922 fabricated as described above are lightweight. The barrier segments 922 can also be easily disassembled for storage and transportation. Reassembly of the barrier segments 922 is easy and quick and can be accomplished on-site with simple tools and minimum effort.

Given the foregoing, it should be apparent that the present invention may be embodied in forms other than those described above. For example, the barrier system may be modular system that incorporates aspects of any one or a combination of the various segment types described. In addition, a particular implementation may employ no stabilization structure or a stabilization structure containing any combination of keels, ballast, and/or outriggers. The scope of the present invention should thus not be limited to the details of the foregoing detailed description of the invention.

I claim:

1. A marine barrier system comprising:

first and second barrier sections comprising first and second main flotation members, respectively, where each main flotation member is a hollow plastic pipe and contains buoyant material;

at least one post member associated with each barrier section, where at least a portion of each post member extends into the main flotation member;

first and second cables extending through the first and second main flotation members, respectively;

a coupler system arranged at the juncture of the first and second barrier sections, the coupler system comprising a chain assembly connected to and extending between ends of the cables of adjacent main flotation members such that the cables and the chain assembly form a continuous connection along the entire length of the barrier system; whereby the chain assembly comprises first and second chain segments and first and second intermediate rings, the first and second intermediate rings are operatively connected to the first and second cables, respectively, the first and second chain segments are operatively connected to the first and second intermediate rings, respectively, the first chain segment is operatively connected to the second chain segment, and at least one of the post members extends through one of the intermediate rings; and the chain assembly is configured such that the first and second main flotation members may be placed in a storage configuration in which the first and second main flotation members are arranged in a parallel, side by side arrangement, and a deployed configuration in which the first and second main flotation members are arranged end to end to define a barrier line in a body of water across which movement is limited.

2. A marine barrier system as recited in claim 1, further comprising a fence system supported by the post members, where the fence system extends from the first and second flotation members to limit movement across the barrier line.

3. A marine barrier system as recited in claim 1, further comprising a stabilizing system adapted to maintain the main floatation members in a predetermined orientation when the barrier sections float in the body of water.

4. A marine barrier system as recited in claim 1, further comprising:

a fence system supported by the post members, where the fence system extends from the first and second flotation members to limit movement across the barrier line; and a stabilizing system adapted to maintain the fence system in a predetermined orientation when the barrier sections float in the body of water.

5. A marine barrier system as recited in claim 1, in which:

the first and second flotation members are substantially cylindrical; and an effective length of the chain assembly is at least as long as a diameter of the flotation members.

6. A marine barrier system as recited in claim 1, in which the chain assembly is constructed to resiliently oppose movement of the first and second barrier sections away from each other.

7. A marine barrier system as recited in claim 6, in which the chain assembly is disposed within a body of resilient material.

8. A marine barrier system as recited in claim 1, in which the chain assembly further comprises a coupler assembly for detachably attaching the first and second chain segments.

* * * * *